US011371718B2

(12) United States Patent
Ren et al.

(10) Patent No.: US 11,371,718 B2
(45) Date of Patent: Jun. 28, 2022

(54) FUME COLLECTING ASSEMBLY, RANGE HOOD, SIDE SUCTION RANGE HOOD, RANGE HOOD FOR TWO-SIDED FUME COLLECTION AND CENTRAL AIR INTAKE, RANGE HOOD WITH PARTITION, AND CENTRAL FUME PURIFICATION DEVICE

(71) Applicant: HANGZHOU ROBAM APPLIANCES CO., LTD., Zhejiang (CN)

(72) Inventors: Fujia Ren, Hangzhou (CN); Rongwei Hu, Hangzhou (CN); Haixin Zhou, Hangzhou (CN); Liecun Lu, Hangzhou (CN); Guocheng Yu, Hangzhou (CN); Ming Li, Hangzhou (CN); Jiachen Xu, Hangzhou (CN); Xiuhao Tang, Hangzhou (CN); Feng He, Hangzhou (CN)

(73) Assignee: Hangzhou ROBAM Appliances Co., Ltd., Zhejiang (CN)

( * ) Notice: Subject to any disclaimer, the term of this patent is extended or adjusted under 35 U.S.C. 154(b) by 142 days.

(21) Appl. No.: 16/652,992

(22) PCT Filed: Sep. 10, 2018

(86) PCT No.: PCT/CN2018/104782
§ 371 (c)(1),
(2) Date: Apr. 2, 2020

(87) PCT Pub. No.: WO2019/072059
PCT Pub. Date: Apr. 18, 2019

(65) Prior Publication Data

US 2020/0232649 A1 Jul. 23, 2020

(30) Foreign Application Priority Data

Oct. 10, 2017 (CN) ..... 201710932874.4
Nov. 16, 2017 (CN) ..... 201721531012.2
(Continued)

(51) Int. Cl.
*F24C 15/20* (2006.01)

(52) U.S. Cl.
CPC ..... *F24C 15/2042* (2013.01); *F24C 15/20* (2013.01); *Y10S 55/36* (2013.01)

(58) Field of Classification Search
CPC ..... F24C 15/20; F24C 15/2071; Y10S 55/36; B08B 15/02; B08B 15/023; B08B 15/00
See application file for complete search history.

(56) References Cited

U.S. PATENT DOCUMENTS 2,827,115 A * 3/1958 Stroup ..... E05D 15/24 160/229.1
3,199,435 A * 8/1965 Jenson ..... F24C 15/20 126/299 D
(Continued)

FOREIGN PATENT DOCUMENTS

CN 1971148 A * 5/2007
CN 201476133 U * 5/2010
(Continued)

OTHER PUBLICATIONS

PCT Written Opinion of the International Searching Authority, Application No. PCT/CN2018/104782, dated Nov. 29, 2018.
(Continued)

*Primary Examiner* — Jorge A Pereiro
(74) *Attorney, Agent, or Firm* — MacMillan, Sobanski & Todd, LLC

(57) ABSTRACT

A fume collecting assembly, a range hood, a side suction range hood, a range hood for two-sided fume collection and
(Continued)

central air intake, a range hood with partition, and a central fume purification device are provided. The fume collecting assembly includes a fume collecting panel having curved recessed portion and an air deflector, which has curved protruding portion and is connected to the fume collecting panel, and the curved protruding portion is opposite the curved recessed portion, forming first air inlet and second air inlet spaced apart. The fume collecting panel includes a fume collecting port for discharging fumes into a duct of range hood. The first air inlet and the second air inlet both communicate with the fume collecting port. The range hood, the side suction range hood, the range hood for two-sided fume collection and central air intake, and the range hood with partition include the fume collecting assembly.

20 Claims, 10 Drawing Sheets

(30) Foreign Application Priority Data

Jan. 29, 2018 (CN) ..... 201810083670.2
Mar. 7, 2018 (CN) ..... 201820310080.4
Mar. 7, 2018 (CN) ..... 201820313549.X

(56) References Cited

U.S. PATENT DOCUMENTS 3,218,772 A * 11/1965 Martin ..... E04F 13/0864 52/508
3,930,680 A * 1/1976 Littlefield ..... B60P 3/04 296/10
D241,396 S * 9/1976 Copeland ..... D25/119
4,580,383 A * 4/1986 Pittman ..... E04D 1/08 52/520
4,584,929 A * 4/1986 Jarmyr ..... B08B 15/02 454/57
4,637,302 A * 1/1987 Enberg ..... B08B 15/023 454/57
6,470,880 B1 * 10/2002 Chang ..... F24C 15/20 126/299 D
D489,805 S * 5/2004 Vetter ..... F24C 15/20 D23/371
7,571,571 B1 * 8/2009 Mershon ..... A47F 5/0846 211/94.01
2004/0149278 A1 * 8/2004 Lin ..... F24C 15/2035 126/299 R
2005/0051158 A1 * 3/2005 Klemm ..... B08B 15/02 126/299 R
2007/0227526 A1 * 10/2007 Liao ..... F24C 15/20 126/299 R
2009/0288655 A1 * 11/2009 Tsai ..... F24C 15/2035 126/299 R
2010/0043772 A1 * 2/2010 Grobleben ..... F24C 15/2092 126/299 D
2010/0081370 A1 * 4/2010 Weng ..... F24F 13/02 454/249

FOREIGN PATENT DOCUMENTS

CN 103697513 A 4/2014
CN 104456675 A 3/2015
CN 104566568 A 4/2015
CN 204345752 U 5/2015
CN 205002189 U * 1/2016
CN 106560657 A * 4/2017
CN 206320818 U 7/2017
CN 107559915 A 1/2018
CN 108050564 A 5/2018
CN 207527672 U 6/2018
CN 207975706 U 10/2018
EP 1239226 A2 * 9/2002 ..... F24C 15/20
JP 2005282872 A * 10/2005

OTHER PUBLICATIONS

Australian Government, Notice of Acceptance for Patent Application, Application No. 2018347080, dated Jul. 30, 2021.
Australian Government, Examination Report No. 1 for Standard Patent Application, Application No. 2018347080, dated Dec. 17, 2020.
Substantive Examination Report Stage I, Application No. P00202002654.
Intellectual Property India, Examination report under sections 12 & 13 of the Patents Act, 1970 and the Patents Rules, 2003, Application No. 202027016360, dated Oct. 27, 2020.

* cited by examiner

FUME COLLECTING ASSEMBLY, RANGE HOOD, SIDE SUCTION RANGE HOOD, RANGE HOOD FOR TWO-SIDED FUME COLLECTION AND CENTRAL AIR INTAKE, RANGE HOOD WITH PARTITION, AND CENTRAL FUME PURIFICATION DEVICE

PRIORITY

This application is a U.S. national application of the international application number PCT/CN2018/104782 filed on Sep. 10 2018, and claiming priority of Chinese applications CN201710932874.4, CN201721531012.2, CN201810083670.2, CN201820310080.4 and CN201820313549.X, filed respectively on Oct. 10, 2017; Nov. 16, 2017; Jan. 29, 2018; Mar. 7, 2018 and Mar. 7, 2018, the contents of all of which are incorporated herein by reference.

TECHNICAL FIELD

The present disclosure relates to the technical field of kitchen appliances, and in particular to a fume collecting assembly, a range hood, a side suction range hood, a range hood for two-sided fume collection and central air Intake (a range hood for collecting fume at two sides and intaking air at center), a range hood with a partition (i.e., sail-shaped plate), and a central fume purification device.

BACKGROUND ART

A range hood, also known as an extractor hood, is a kitchen appliance for purifying the kitchen environment, by which exhaust gas generated by combustion at a gas stove and oil fumes generated during cooking can be quickly drawn out and discharged to the outside of the house to achieve the purpose of purifying the kitchen environment. The range hoods may be divided into two types, i.e., top-suction range hoods and side suction range hoods, according to the principles of operation of the range hoods. The side suction range hoods have found favor with most consumers, as the side suction range hood has an air inlet closer to the source of oil fumes so that it can target the generated oil fumes in the first time and have a more satisfactory fume discharging effect.

In the prior side suction range hoods, in general, an air deflector is arranged at the fume collecting port of each of the range hoods in order to gather and guide oil fumes generated during cooking to the air duct of the range hood, and the concentrated introduction of the oil fumes is achieved by using a gap between the air deflector and the main body of the range hood. However, there is a limited spacing between the air deflector and the main body of the prior range hood, so that the air intake area of the range hood is greatly reduced, whereby the fume suction (or extraction) effect of the range hood is greatly weakened.

SUMMARY

The object of the present disclosure includes providing a fume collecting assembly to solve the technical problem of poor fume suction effect of the prior range hoods.

The present disclosure provides a fume collecting assembly, comprising a fume gathering panel having a curved concave portion and an air deflector having a curved convex portion, wherein the air deflector is connected to the fume gathering panel, and the curved convex portion and the curved concave portion are opposite to each other and jointly form a first air inlet and a second air inlet spaced apart from each other.

The fume gathering panel comprises a fume collecting port, which is configured to discharge oil fumes into an air duct of a range hood, and both the first air inlet and the second air inlet communicates with the fume collecting port.

Further, the fume collecting assembly further comprises a skeletal front plate located between the fume gathering panel and the air deflector, the skeletal front plate is mounted to the fume gathering panel and supports the air deflector, and the first air inlet and the second air inlet are both provided on the skeletal front plate and are located on the left and right sides of the skeletal front plate, respectively.

Further, the fume gathering panel is provided with a notch, and a lower end of the air deflector extends into the notch.

The fume collecting assembly of the present disclosure brings about the following advantageous effects:

A fume gathering panel having a curved concave portion and an air deflector having a curved convex portion are arranged, wherein after the air deflector is connected together with the fume gathering panel, its curved convex portion is opposite to the curved concave portion of the fume gathering panel, and the curved convex portion and the curved concave portion arranged opposite to each other jointly form a first air inlet and a second air inlet spaced apart from each other. The fume gathering panel comprises a fume collecting port from which oil fumes are discharged into an air duct of a range hood, and both the first air inlet and the second air inlet communicates with the fume collecting port.

In the fume collecting assembly, a first air inlet and a second air inlet having a certain fume suction area are formed by using a curved concave portion and a curved convex portion which are arranged opposite to each other on the fume gathering panel and the air deflector, so that oil fumes generated during cooking can be discharged in time. The fume collecting assembly allows an increase in the air intake area, ameliorates the situation that the prior range hood has an unsatisfactory fume suction effect due to a small spacing between the air deflector and the range hood body, and enhances the fume suction effect of the range hood, thereby reducing an arbitrary flow of oil fumes to the kitchen environment and improving the user experience; and moreover, the fume collecting assembly increases the amount of oil fumes discharged to the air duct of the range hood per unit time, thereby improving the fume discharging efficiency and effectively reducing oil fume contaminants in the kitchen environment.

In addition, the fume collecting assembly has a simple structure, is designed with an easily implementable solution, and has low cost, which is of great significance for improving the kitchen environment.

The object of the present disclosure also includes providing a range hood to solve the technical problem of poor fume suction effect of the prior range hoods.

The present disclosure provides a range hood, comprising a range hood body and a fume collecting assembly described above.

The fume collecting assembly is mounted to the range hood body, and the fume collecting port communicates with an air duct located inside the range hood body.

Further, the range hood further comprises an oil receptacle mounted at the bottom of the range hood body, wherein the air deflector extending into a notch of the fume gathering panel can direct an oil liquid into the oil receptacle.

Further, the range hood further comprises a switch component configured for controlling the range hood, the air deflector is detachably fixedly mounted to a skeletal front plate of the fume collecting assembly, and the switch component is detachably fixedly connected to the air deflector.

Further, the range hood further comprises a locking member fixedly arranged at the bottom of the air deflector, the locking member comprises an overlapping edge, the overlapping edge is arranged at an angle from the air deflector, and the locking member extends into a notch of the fume gathering panel and is overlapped onto the range hood body.

Further, a guiding edge is extended from the overlapping edge towards a direction of an oil outlet of the range hood body, and an oil receptacle of the range hood is arranged directly under the oil outlet.

Further, the range hood further comprises a centrifugal fan configured for discharging oil fumes, an air duct of the centrifugal fan is provided with a bottom hole of the air duct, and an oil liquid in the air duct can drip onto the fume gathering panel through the bottom hole of the air duct and then flow to the oil outlet along the fume gathering panel.

Further, the fume gathering panel is connected to both sides of the air deflector and forms a fume gathering region together with an outline of the air deflector.

Both sides of the air deflector are inclined from the center towards both sides from bottom to top, so that the fume gathering region is gradually narrowed from bottom to top to form a positive pressure region.

Further, the air deflector comprises an upper plate and a lower plate, the lower plate, from bottom to top, is inclined from rear to front, the curved convex portion is located between the upper plate and the lower plate, and the switch component is arranged on the upper plate;

wherein the upper plate is arranged vertically; or the upper plate, from bottom to top, is inclined from rear to front at an angle $\alpha$, less than 15°, from a vertical plane; and/or an angle $\beta$ between the lower plate and the vertical plane satisfies $30° \leq \beta \leq 45°$.

Further, the air deflector and the fume gathering panel are opposed to each other to form a hollow portion, the range hood further comprises a partition plate, which is placed in the hollow portion and divides the hollow portion into a left chamber and a right chamber, and the partition plate partitions the fume collecting port into a left fume collecting port and a right fume collecting port.

Further, the range hood further comprises a driving device arranged in range hood body, wherein the driving device is configured to drive the partition plate to slide;

the driving device comprises a driving member, a first connecting rod, a second connecting rod, and a third connecting rod, a first pivot joint is arranged in the range hood body, a second pivot joint is arranged on the blocking member, a driving end of the driving member, the first connecting rod, the second connecting rod, and the third connecting rod are sequentially hinged, and the driving member is mounted in the range hood body, the second connecting rod, at its position close to the first connecting rod, is pivotably connected to the first pivot joint, and a free end of the third connecting rod is hinged to the second pivot joint; or the driving device comprises a driving member, a fourth connecting rod, and a fifth connecting rod, a third pivot joint is arranged in the range hood body, a fourth pivot joint is arranged on the blocking member, a driving end of the driving member, the fourth connecting rod, and the fifth connecting rod are sequentially hinged, and the driving member is pivotably connected in the range hood body, the fourth connecting rod, at its position close to the driving member, is pivotably connected to the third pivot joint, and a free end of the fifth connecting rod is hinged to the fourth pivot joint.

Further, the range hood further comprises a base mounted between the air deflector and the fume gathering panel, the partition plate is pivotably connected to the base, a driving device is mounted to an inner side wall of the air deflector, the driving device is configured to drive a rotation of the partition plate, a switch component of the range hood is arranged on an outer side wall of the air deflector, and the switch component is electrically connected to the driving device.

Further, the range hood body is provided with an oil fume sensor, the oil fume sensor is electrically connected with a microprocessor, the microprocessor is electrically connected to the driving device, and the driving device is configured to drive a rotation of the partition plate.

The object of the present disclosure also includes providing a side suction range hood to solve the technical problem of inconvenient cleaning of switch components of the prior side suction range hoods.

The present disclosure provides a side suction range hood, comprising a range hood body, an air deflector, and a switch component configured for controlling the side suction range hood;

wherein the air deflector is detachably fixedly mounted to the range hood body, and the switch component is fixedly arranged on the air deflector.

The object of the present disclosure also includes providing a range hood for two-sided fume collection and central air intake to improve the fume suction efficiency of the range hood.

The present disclosure provides a range hood for two-sided fume collection and central air intake, comprising a range hood body, a fume gathering panel, and a fume-collection and air-intake structure, wherein the fume-collection and air-intake structure is configured in a form of protruding from rear to front, a hollow portion is formed in the protrusion, air inlets communicating with the hollow portion are provided on both left and right sides of the protrusion, the range hood body is connected with the fume-collection and air-intake structure for collecting fumes entering the hollow portion and then discharging the fumes to the outside, the fume gathering panel, from bottom to top, is inclined from rear to front, and the fume gathering panel is connected with both sides of the fume-collection and air-intake structure and the fume gathering panel, together with an outline of the fume-collection and air-intake structure, forms a fume gathering region.

The object of the present disclosure also includes providing a range hood to improve the fume suction efficiency of the range hood.

The present disclosure provides a range hood, comprising a range hood body, wherein a fume gathering panel of the range hood body is sequentially provided with a first air inlet and a second air inlet along a length direction thereof, wherein the first air inlet is located at the right half of the fume gathering panel, and the second air inlet is located at the left half of the fume gathering panel;

a blocking member and a driving device are arranged in the range hood body, and the driving device is configured to drive the blocking member to block the first air inlet or the second air inlet.

The object of the present disclosure also includes providing a range hood with a partition to solve the technical problem of low fume suction efficiency of the prior range hoods.

The present disclosure provides a range hood with a partition, comprising a range hood body, wherein a fume collecting port is provided in the middle of a fume gathering panel of the range hood body, a fume outlet is provided on a top plate of the range hood body, and the fume outlet communicates with the fume collecting port.

The fume collecting port is externally covered with a partition cover, the partition cover partitions the fume collecting hood into a left fume gathering chamber and a right fume gathering chamber, a left fume collecting port and a right fume collecting port are provided on left and right side surfaces of the partition cover, respectively, a sail-shaped plate is pivotably connected inside the partition cover, and the sail-shaped plate is inserted into the fume collecting port to partition the fume collecting port into two left and right passage ports.

The range hood of the present disclosure brings about the following advantageous effects:

A range hood body and the above-mentioned fume collecting assembly mounted to the range hood body are arranged in the range hood, so that during normal use of the range hood, oil fumes generated by cooking can be introduced into the fume collecting port through the first air inlet and the second air inlet and further introduced into the air duct and discharged to the outside environment after being purified by the air duct.

Correspondingly, this range hood has all the advantages of the fume collecting assembly described above, which will not be described in detail herein.

The object of the present disclosure also includes providing a central fume purification device to solve the technical problem of low fume suction efficiency of the prior oil fume purification device.

The present disclosure provides a central fume purification device, comprising a public flue and a range hood described above, wherein an exhaust pipe of the range hood communicates with the public flue.

The central fume purification device of the present disclosure brings about the following advantageous effects:

The central fume purification device proposed in the present disclosure comprises a plurality of range hoods for extracting oil fumes from the kitchen and a public flue for conveying the oil fumes. When in use, the plurality of range hoods may work independently of one another, the range hood in the working state discharges the oil fumes extracted from the kitchen into the public flue through the exhaust pipe, and the public flue conveys the oil fumes collected by the plurality of range hoods to a subsequent purification device for treatment of the oil fumes. Here, during use of this range hood, when the amount of oil fumes generated by the left stove is different from the amount of oil fumes generated by the right stove, the angle of the partition plate may be adjusted to adjust the sizes of two passage ports into which the fume collecting port is partitioned by the partition plate, so as to properly distribute the forces for suction of oil fumes from the left and right sides, so that the oil fumes generated by the stoves on the left and right sides can be sucked cleanly in the case where the fan system generates a constant suction force, and hence the oil fume suction effect and efficiency of the range hood are improved.

BRIEF DESCRIPTION OF DRAWINGS

In order to more clearly illustrate technical solutions of specific embodiments of the present disclosure or of the prior art, drawings required for use in the description of the specific embodiments or the prior art will be described briefly below. It is obvious that the drawings in the following description are merely illustrative of some embodiments of the present disclosure. It will be understood by those of ordinary skill in the art that other drawings can also be obtained from these drawings without any inventive effort.

Figure 1:
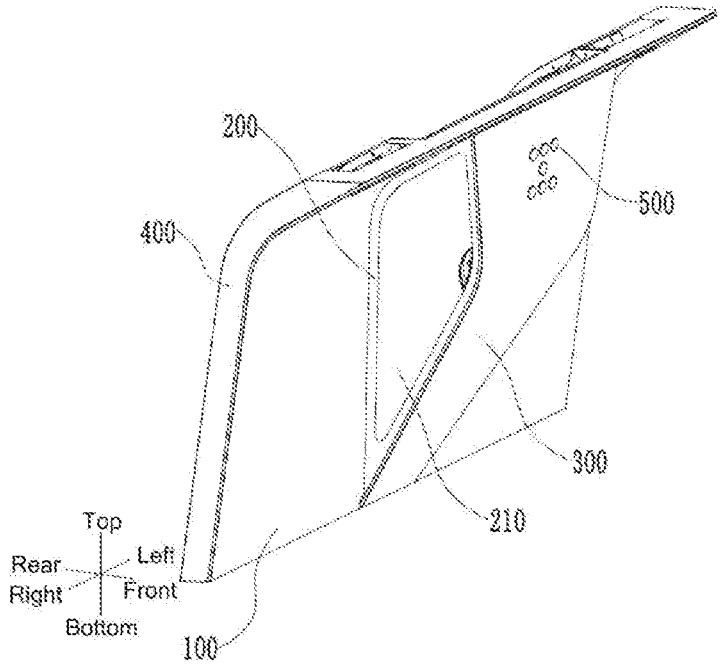
FIG. 1 is a schematic structural view of a fume collecting assembly according to an embodiment of the present disclosure.

Reference signs: 100—fume gathering panel; 200—skeletal front plate; 300—air deflector; 400—mounting plate; 500—switch component; 600—oil receptacle; 700—range hood body; 800—mounting bracket; 900—locking member; 11—right fume gathering region; 12—left fume gathering region; 13—blocking member; 14—driving device; 15—driving member; 16—decorative cover; 17—filter screen;

110—fume collecting port; 120—support bracket; 130—notch; 140—fixing hole; 150—curved concave portion; 160—right fume guiding portion; 170—left fume guiding portion;

111—left fume collecting port; 112—right fume collecting port; 113—fume outlet;

210—first air inlet; 220—second air inlet; 230—cavity;

241—pivoting portion; 242—partitioning portion; 243—first pivot shaft; 244—second pivot shaft; 245—engaging slot;

310—curved convex portion; 320—right air intake plate; 330—left air intake plate; 340—partition plate; 350—upper plate; 360—lower plate;

410—opening;

510—button;

710—impeller; 720—air duct; 730—oil outlet; 740—first guide member; 750—first stopper; 760—second guide member; 770—second stopper; 780—fixing frame;

910—overlapping edge; 920—guiding edge;

141—first connecting rod; 142—second connecting rod; 143—third connecting rod; 144—fourth connecting rod; 145—fifth connecting rod; 146—first pivot joint (first pivot seat); 147—second pivot joint (second pivot seat); 148—third pivot joint (third pivot seat); 149—fourth pivot joint (fourth pivot seat);

A—visually unobstructed region; dotted arrows indicate "fumes"; dotted wavy lines indicate "oil liquid".

DETAILED DESCRIPTION OF EMBODIMENTS

In order to further clarify the objects, technical solutions, and advantages of the present disclosure, the technical solutions of the present disclosure will be described below clearly and completely with reference to the drawings. It is apparent that the embodiments to be described are merely some, but not all of the embodiments of the present disclosure. All the other embodiments obtained by those of ordinary skill in the art in light of the embodiments of the present disclosure without inventive efforts will fall within the scope of the present disclosure as claimed.

In the description of the present disclosure, it should be noted that orientation or positional relationships indicated by the terms such as "left", "right", "inside", "outside", "bottom", "horizontal", and the like are the orientation or positional relationships shown based on the drawings, and these terms are intended only to facilitate the description of the present disclosure and simplify the description, but not intended to indicate or imply that the referred devices or elements must be in a particular orientation, or constructed or operated in the particular orientation, and therefore should not be construed as limiting the present disclosure. In addition, the terms "first" and "second" are used for descriptive purposes only, and should not be understood as an indication or implication of relative importance.

In the description of the present disclosure, it should be noted that the terms "connect" and "mount" should be understood broadly unless otherwise expressly specified or defined. For example, connection may be fixed connection or detachable connection or integral connection, or may be direct coupling or indirect coupling via an intermediate medium or internal communication between two elements. The specific meanings of the above-mentioned terms in the present disclosure can be understood by those of ordinary skill in the art according to specific situations.

As shown in FIG. 1, this embodiment provides a fume collecting assembly, comprising a fume gathering panel (also referred to as a baffle, or a fume guiding plate or a fume collecting panel) 100 having a curved concave portion 150 and an air deflector (also referred to as a front plate) 300 having a curved convex portion 310. Specifically, the air deflector 300 is connected to the fume gathering panel 100, and the curved convex portion 310 and the curved concave portion 150 are opposite to each other and jointly form a first air inlet 210 and a second air inlet 220 spaced apart from each other. Here, the fume gathering panel 100 comprises a fume collecting port 110 from which oil fumes are discharged into an air duct 720 of a range hood, and both the first air inlet (also referred to as a right air inlet or an air inlet) 210 and the second air inlet (also referred to as a left air inlet or an air inlet) 220 communicate with the fume collecting port (also referred to as an air suction port) 110.

In the fume collecting assembly, a first air inlet 210 and a second air inlet 220 having a certain fume suction area are formed by using a curved concave portion 150 and a curved convex portion 310 which are arranged opposite to each other on the fume gathering panel 100 and the air deflector 300, so that oil fumes generated during cooking can be discharged in time. The fume collecting assembly allows an increase in the air intake area, ameliorates the situation that the prior range hood has an unsatisfactory fume suction effect due to a small spacing between the air deflector 300 and the range hood body 700, and enhances the fume suction effect of the range hood, thereby reducing an arbitrary flow of oil fumes to the kitchen environment and improving the user experience; and moreover, the fume collecting assembly increases the amount of oil fumes discharged to the air duct 720 of the range hood per unit time, thereby improving the fume discharging efficiency and effectively reducing oil fume contaminants in the kitchen environment.

In addition, the fume collecting assembly has a simple structure, is designed with an easily implementable solution, and has low cost, which is of great significance for improving the kitchen environment.

It should be noted that, in this embodiment, both the "concavity" of the curved concave portion 150 and the "convexity" of the curved convex portion 310 are described based on the normal use state (a state in front view) of the range hood. That is to say, in the state where the range hood is normally used, the curved concave portion 150 is formed at the fume gathering panel 100 toward a direction remote from a user, and the curved convex portion 310 is formed at the air deflector 300 toward a direction close to the user.

Figure 4:
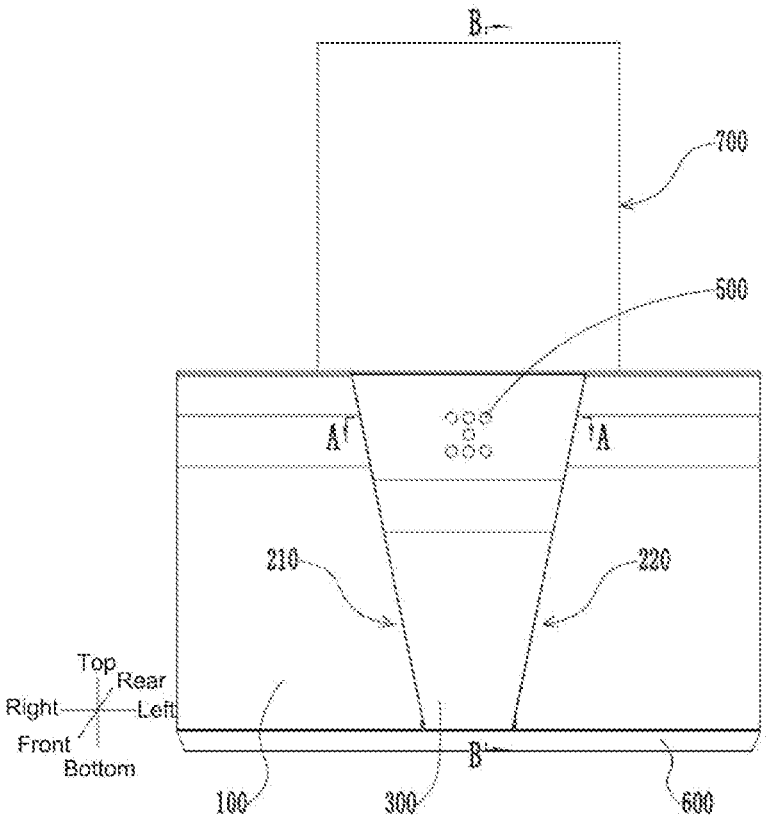
FIG. 4 is a schematic structural front view of a range hood according to an embodiment of the present disclosure.

Continuing referring to FIG. 1 in combination with FIG. 4, in this embodiment, the first air inlet 210 and the second air inlet 220 are located on the left and right sides of the range hood, respectively. Moreover, the first air inlet 210 communicates with the second air inlet 220. Such arrangement reduces the obstruction of oil fumes during the flow thereof, so that both the oil fumes entering from the first air inlet 210 and the oil fumes entering from the second air inlet 220 can smoothly enter the fume collecting port 110, whereby an operational reliability of the fume collecting assembly of this embodiment is further ensured.

It should be noted that, in this embodiment, a filter screen 17 for filtering oil fumes is arranged at each of the first air inlet 210 and the second air inlet 220. The filter screen 17 is arranged to serve a certain function of filtering the oil fumes, so that cleaner oil fumes are discharged to the outside environment through the air duct 720.

Continuing referring to FIG. 1, in this embodiment, the width of the air deflector 300 is smaller than the width of the fume gathering panel 100 so that oil fumes rising upward are guided directly into the first air inlet 210 and the second air inlet 220. With such arrangement, the moving path of the oil fumes is optimized well, so that the oil fumes can be sucked into the fume collecting port 110 along the shortest path while rising upward, whereby the oil fume purification effect of the fume collecting assembly of this embodiment is further improved.

Figure 2:
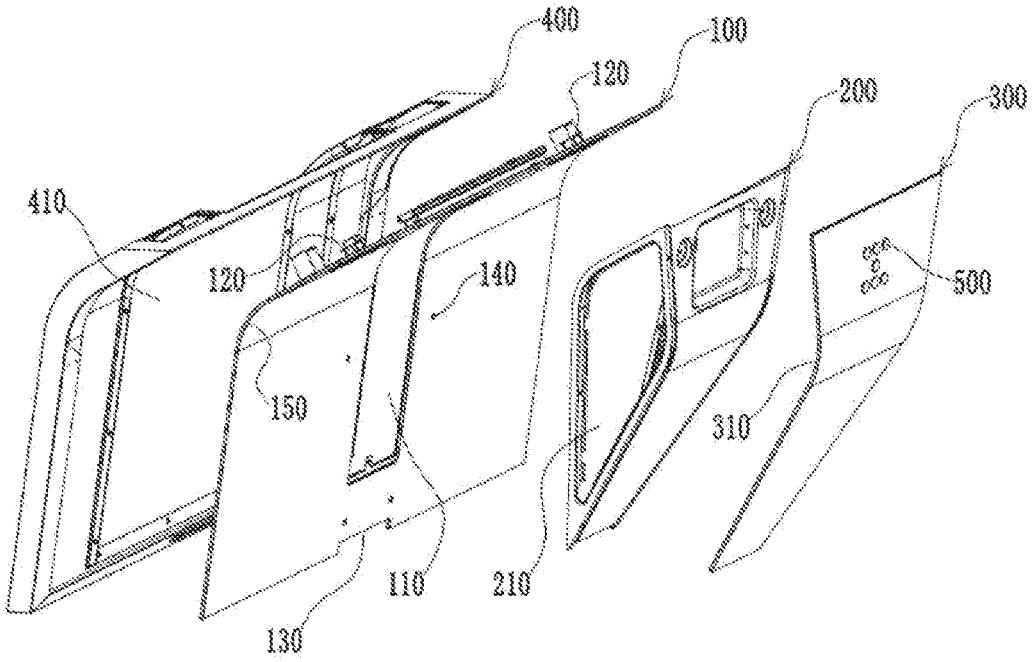
FIG. 2 is an exploded view of a fume collecting assembly according to an embodiment of the present disclosure.

Continuing referring to FIG. 1 in combination with FIG. 2, in this embodiment, the fume collecting assembly may further comprise a skeletal front plate (also referred to as a skeleton or a partition cover) 200 located between the fume gathering panel 100 and the air deflector 300. Specifically, the skeletal front plate 200 is mounted to the fume gathering panel 100 and supports the air deflector 300, wherein both the first air inlet 210 and the second air inlet 220 are provided on the skeletal front plate 200 and are located on the left and right sides of the skeletal front plate 200, respectively.

During the assembling of the fume collecting assembly, the skeletal front plate 200 may be first mounted to the fume gathering panel 100 so that they together form a panel assembly, and then the air deflector 300 is assembled so that it can be stably mounted in front of the fume gathering panel 100.

Specifically, in this embodiment, the air deflector 300 may be connected to the fume gathering panel 100, or may be connected to a range hood body (also referred to as a fume collecting hood) 700. Here, the air deflector 300 may be detachably connected to the fume gathering panel 100 or the range hood body 700. The air deflector 300 may be detached from the fume collecting assembly and cleaned after use for a period of time, which is very convenient and greatly improves the efficiency of maintenance of the air deflector 300. Specifically, the detachable connection may include threaded connection, connection with a locking member 900, etc.

The skeletal front plate 200 is arranged to improve the structural stability of the fume collecting assembly, avoid, to a certain extent, the damage of the air deflector 300 caused by an external force, ensure an operational reliability of the fume collecting assembly of this embodiment, and prolong its service lifetime.

It should be noted that, in this embodiment, the skeletal front plate 200 comprises a plate portion arranged to be stacked relative to the air deflector 300 and a support portion approximately perpendicularly connected to the plate portion. Two support portions are provided and are located on the left and right sides of the plate portion, respectively, wherein the first air inlet 210 and the second air inlet 220 are arranged on the respective support portions, respectively.

In addition, it should also be noted that, in this embodiment, the first air inlet 210 and the second air inlet 220 may be embodied in a structural form shown in the figure in which only one first air inlet and only one second air inlet are provided on the skeletal front plate 200, respectively, but they are not limited thereto, and may be provided in other forms, for example, a plurality of first air inlets and a plurality of second air inlets may be provided, respectively, as long as the guiding and suction of oil fumes can be achieved by the first air inlet(s) 210 and the second air inlet(s) 220 provided on the skeletal front plate 200.

Continuing referring to FIG. 2, in this embodiment, the skeletal front plate 200 is detachably fixedly connected to the fume gathering panel 100.

When it is necessary to maintain the fume collecting assembly, the fume gathering panel 100, the skeletal front plate 200, and the air deflector 300 may be disassembled into individual components and maintained separately. With such arrangement, not only inadequate cleaning caused by the presence of uncleanable corners is avoided to a certain extent to prevent the accumulation of greasy dirt, but also the user is allowed to choose a suitable location for maintenance to avoid a pain of an arm caused by raising the arm for cleaning for a long time, thereby further enhancing the user experience.

Continuing referring to FIG. 2, in this embodiment, a number of fixing holes 140 are provided at positions of the fume gathering panel 100 close to the fume collecting port 110, and mounting holes (not shown in the figure) are provided at a side of the skeletal front plate 200 close to the fume gathering panel 100, wherein both the positions and number of the mounting holes match those of the fixing holes 140. The mounting and fixing of the skeletal front plate 200 to the fume gathering panel 100 can be achieved by using threaded connectors passing through the respective mounting holes and screwed into the corresponding fixing holes 140.

Continuing referring to FIG. 1 and FIG. 2, in this embodiment, a notch 130 may be provided on the fume gathering panel 100, wherein a lower end of the air deflector 300 extends into the notch 130.

In this way, an oil liquid falling back onto the air deflector 300 can flow into the notch 130 along the inner surface of the air deflector 300 and be further collected, such that the oil path structure is optimized well, and moreover, outflow of the oil liquid from a gap between the bottom of the air deflector 300 and the fume gathering panel 100 is avoided to a certain extent, so that overflow of the oil liquid is reduced, thereby reducing the contamination of the cooking environment caused by the fume collecting assembly of this embodiment and further improving the user experience.

Specifically, in this embodiment, the notch 130 is located at the contour edge of the bottom of the fume gathering panel 100. Such arrangement not only facilitates processing and manufacturing, but also maximally ensures the supporting area of the skeletal front plate 200, thereby further improving the structural stability of the fume collecting assembly of this embodiment.

It should be noted that, in this embodiment, the fume collecting port 110 may be completely projected onto the air deflector 300 in the state where the fume collecting assembly is in use. In this way, the oil liquid falling back in the direction of the air deflector 300 through the fume collecting port 110 can be completely directed by the air deflector 300, the overflow of the oil liquid is reduced or even avoided, and the effect of further maintaining the cooking environment is achieved.

As shown in FIG. 4, this embodiment also provides a range hood, comprising a range hood body 700 and a fume collecting assembly described above. Specifically, the fume collecting assembly is mounted to the range hood body 700, and the fume collecting port 110 communicates with an air duct 720 of the range hood body 700.

A range hood body 700 and the above-mentioned fume collecting assembly mounted to the range hood body 700 are arranged in the range hood, so that during normal use of the range hood, oil fumes generated by cooking can be introduced into the fume collecting port 110 through the first air inlet 210 and the second air inlet 220 and further introduced into the air duct 720 and discharged to the outside environment after being purified by the air duct 720.

Correspondingly, this range hood has all the advantages of the fume collecting assembly described above, which will not be described in detail herein.

It should be noted that, in this embodiment, a centrifugal fan (not shown in the figure) may be arranged in the air duct 720, and oil fumes in the air duct 720 are purified and discharged to the outside environment while being driven by the centrifugal fan.

Figure 3:
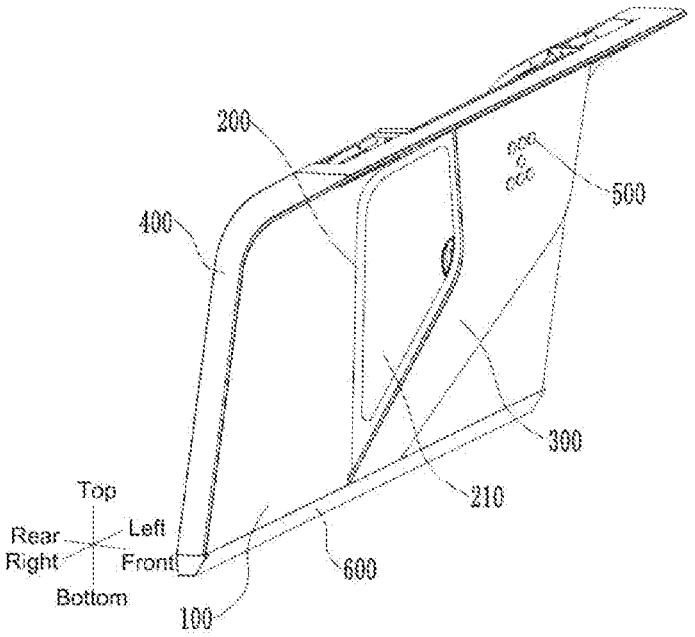
FIG. 3 is a schematic structural view of a fume collecting assembly according to an embodiment of the present disclosure to which an oil receptacle is mounted.

Continuing referring to FIG. 1 to FIG. 3, in this embodiment, the range hood body 700 may further comprise a mounting plate 400 arranged near the fume collecting port 110. Specifically, the mounting plate 400 is provided with an opening 410 through which oil fumes entering from the fume collecting port 110 are introduced into the air duct 720, and the fume gathering panel 100 is detachably connected to the mounting plate 400.

Continuing referring to FIG. 2, specifically, in this embodiment, a number of support brackets 120 are fixedly arranged on the fume gathering panel 100, and the respective support brackets 120 are arranged at intervals. The mounting plate 400 is correspondingly provided with connecting portions. The fixed connection of the fume gathering panel 100 to the mounting plate 400 can be achieved by connection and fixation of the respective support brackets 120 to the connecting portions.

Continuing referring to FIG. 3 and FIG. 4, in this embodiment, the range hood may further comprise an oil receptacle 600 mounted at the bottom of the range hood body 700. Specifically, the air deflector 300 extending into the notch 130 of the fume gathering panel 100 can direct the oil liquid into the oil receptacle 600 such that the concentrated collection of the oil liquid is achieved by using the oil receptacle 600.

The oil receptacle 600 is arranged to achieve the collection of the oil liquid, reduce the contamination of the kitchen environment caused by waste cooking oil, and ensure the cleanliness of the operating environment in the kitchen to a certain extent.

Continuing referring to FIG. 1 to FIG. 4, in this embodiment, the range hood may further comprise a switch component 500 configured for controlling the range hood. Specifically, the switch component 500 may be fixedly arranged on the skeletal front plate 200, and have buttons 510 arranged to extend from the air deflector 300 (arranged to face the user). Such arrangement greatly facilitates the control of the range hood of this embodiment by the user, thereby further improving the user experience.

It should be noted that, in this embodiment, the switch component 500 may be embodied in a structural form shown in the figure in which it is arranged in the middle of the air deflector 300, but it is not limited thereto, and may be arranged at any other position, for example, on the left side of the air deflector 300 or the right side of the air deflector 300 or the like, as long as such positional arrangement enables the user to control the range hood.

Specifically, in this embodiment, the air deflector 300 is detachably fixedly mounted to the range hood body 700, and the switch component 500 is fixedly arranged on the air deflector 300.

When it is necessary to clean the switch component 500, the air deflector 300 may be first detached from the range hood body 700, and then an operation of cleaning the switch component 500 is performed. In the range hood, the switch component 500 and the air deflector 300 are integrated together, and the relative separation of the switch component 500 from the whole machine is achieved by using the easy detachability of the air deflector 300, which facilitates the operation of cleaning the switch component 500 so as to improve the previous disadvantages of difficult cleaning and inadequate cleaning due to the switch component 500 directly connected to the whole machine and greatly reduce the failure rate. Moreover, the arrangement in which the switch component 500 and the detachable air deflector 300 are integrated together also greatly facilitates the maintenance of the switch component 500, shortens the maintenance cycle, and ensures an operational reliability of the range hood.

Figure 5:
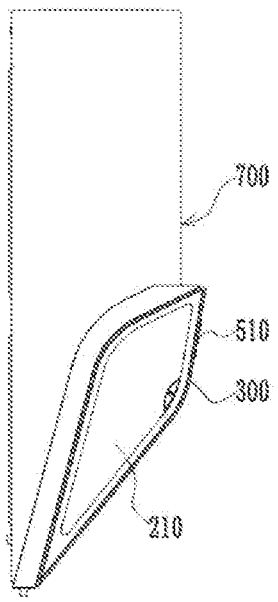
FIG. 5 is a schematic structural left view of a range hood according to an embodiment of the present disclosure.
Figure 6:
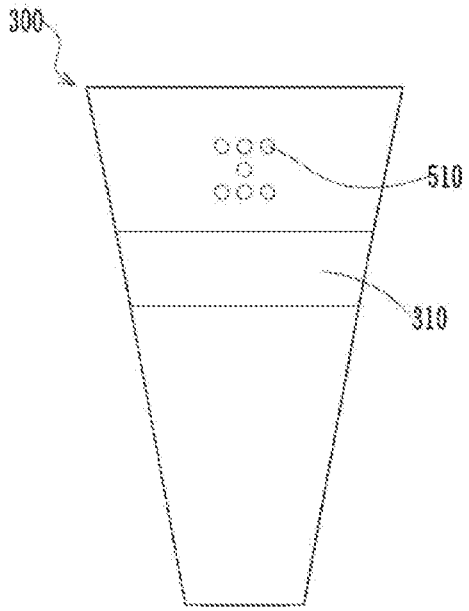
FIG. 6 is a schematic structural front view of an air deflector in a range hood according to an embodiment of the present disclosure.
Figure 9:
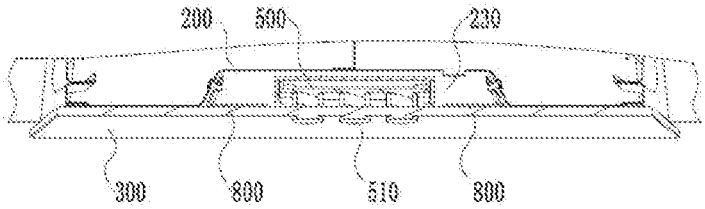
FIG. 9 is a schematic structural sectional view taken along line A-A in FIG. 4, wherein the range hood is schematically partially sectioned.
Figure 10:
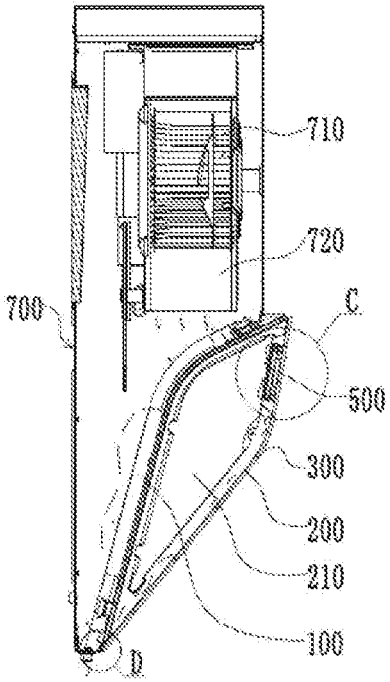
FIG. 10 is a schematic structural sectional view taken along line B-B in FIG. 4.
Figure 11:
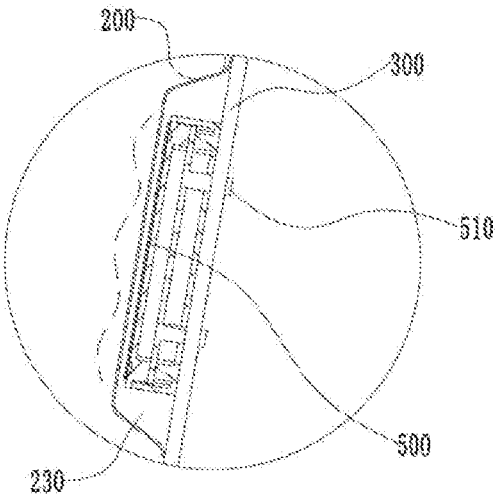
FIG. 11 is a partially enlarged view of portion C in FIG. 10.

Continuing referring to FIG. 4 and FIG. 5 in combination with FIG. 9 and FIG. 10, in this embodiment, the switch component 500 is arranged on a side of the air deflector 300 close to the fume collecting port 110, and the switch component 500 is located between the air deflector 300 and the skeletal front plate 200.

By arranging the switch component 500 on a side of the air deflector 300 close to the fume collecting port 110, not only a bump or damage of the switch component caused by the exposure of the switch component 500 is avoided to a certain extent to ensure an operational reliability of the switch component 500, but also the external space is saved so that the range hood of this embodiment has a more compact structure.

In addition, the switch component 500 is arranged between the skeletal front plate 200 and the air deflector 300 such that oil fumes around the range hood are obstructed by using the skeletal front plate 200, thus the switch component 500 is isolated from the oil fume environment, which greatly reduces an adverse effect of the oil fumes on the switch component 500, an operational reliability of the switch component 500 is further ensured, and hence the reliability of the operation of the range hood of this embodiment is improved.

Continuing referring to FIG. 9 and FIG. 10, in this embodiment, the skeletal front plate 200 is recessed inward towards the direction of the fume collecting port 110 and forms a cavity 230, wherein the switch component 500 is located in the cavity 230. The cavity 230 is arranged to provide a reliable mounting position for the switch component 500 and ensure mounting reliability of the switch component 500.

Continuing referring to FIG. 4 and FIG. 9, in this embodiment, in the state where the range hood is in use, the cavity 230 is sectioned along a plane parallel to the horizontal plane (a section taken along line A-A in FIG. 4) to form mounting surfaces, and the threaded connectors pass through the mounting surfaces and are in screwed fixation to the air deflector 300. Such arrangement allows the assembling and fixing between the air deflector 300 and the skeletal front plate 200 and involves a simple structure and a proper layout.

Continuing referring to FIG. 9, specifically, the cavity 230 has a trapezoidal cross section. Here, the mounting surfaces are corresponding to the two nonparallel sides of the trapezoid, the two nonparallel sides of the trapezoid abut against the air deflector 300, and the two nonparallel sides of the trapezoid extend in directions away from the center of the air deflector 300, respectively.

Figure 7:
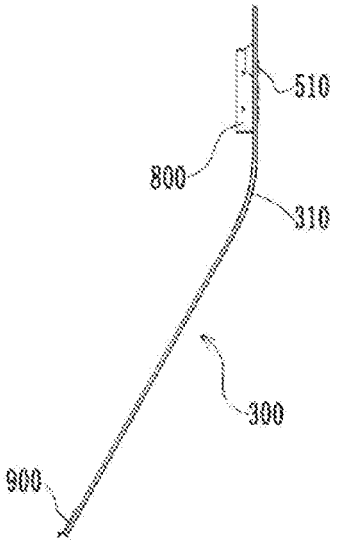
FIG. 7 is a schematic structural left view of the air deflector in FIG. 6.
Figure 8:
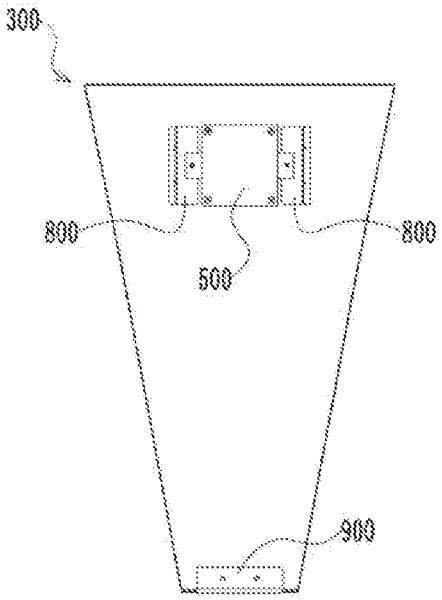
FIG. 8 is a schematic structural rear view of the air deflector in FIG. 6.

Continuing referring to FIG. 7 to FIG. 9, in this embodiment, two mounting brackets 800 are fixedly arranged on the air deflector 300, and the mounting brackets 800 are arranged close to the mounting surfaces, respectively, and the threaded connectors pass sequentially through the mounting surfaces and are in screwed fixation into the mounting brackets 800 corresponding to the mounting surfaces.

The cavity 230 with a trapezoidal sectional shape is arranged so that after the filter screens 17 of the first air inlet 210 and the second air inlet 220 are detached, the two mounting surfaces can be respectively exposed to the left and right sides of the air deflector 300 to provide enough operating space for the mounting and detachment of the threaded connectors, so that the air deflector 300 can be quickly detached, and convenient dismounting and mounting of the air deflector 300 are ensured. Moreover, this structural form also enables the skeletal front plate 200 to have better load-bearing performance during the mounting of the threaded connectors, thereby avoiding, to a certain extent, the unfavorable situation that the skeletal front plate 200 is damaged due to the stress concentration phenomenon.

In addition, when it is necessary to perform an operation of cleaning the skeletal front plate 200, the open design of the cavity 230 also reduces uncleanable corners, whereby the cleaning efficiency is improved, but also the cleanliness of the skeletal front plate 200 is ensured, and the user experience is further improved.

In order to ensure a connection reliability, in this embodiment, each of the mounting brackets 800 is provided with two connecting holes as shown in FIG. 7, and correspondingly, each of the mounting surfaces of the cavity 230 is provided with two mounting holes.

It should be noted that, in this embodiment, the number of the mounting brackets 800 may be two as described above, but it is not limited thereto.

Any other number of mounting brackets may be used, and for example, two mounting brackets 800 are correspondingly arranged at each mounting surface, as long as the reliable fixation of the air deflector 300 to the skeletal front plate 200 can be achieved by such a number of mounting brackets 800.

It should also be noted that, in this embodiment, the threaded connection involves a simple structure, allows a reliable connection, and involves low cost. Specifically, the threaded connector may be in the form of a bolt or a screw or the like, and the specific structural form of the threaded connector is not limited in this embodiment.

In this embodiment, the air deflector 300 may be made of glass, and the mounting bracket 800 may be fixed to the air deflector 300 by means of bonding. Glass is derivable from a wide range of sources and has high thermal stability and long service lifetime.

It should be noted that, in this embodiment, the air deflector 300 may be made of glass as described above, but is not limited thereto, and may be made from other structural form, such as metal or the like. In this case, the mounting bracket 800 may be connected to the air deflector 300 by means of welding or screwing or the like.

In this embodiment, the surface of the air deflector 300 may also be sprayed with a coating to which oil does not stick. Such arrangement greatly reduces the adhesion of the oil liquid to the surface of the air deflector 300, which makes it convenient for the user to clean the air deflector and also reduces the frequency at which the air deflector 300 will be cleaned by the user.

Continuing referring to FIG. 8, in this embodiment, the switch component 500 is detachably fixedly mounted to the mounting bracket 800. Specifically, an edge of the switch component 500 is provided with a connecting lug, and the fixed connection between the switch component 500 and the mounting bracket 800 may be achieved by a threaded connector passing through the connecting lug and being in screwed fixation into the mounting bracket 800.

It should be noted that, in this embodiment, the switch component 500 may be embodied in the above-mentioned structural form in which the switch component is fixed to the mounting bracket 800 by screwing, but it is not limited thereto, and they may be connected by other means, such as clamping or insertion or the like, as long as the detachable fixed connection between the switch component 500 and the mounting bracket 800 can be achieved by such connection means.

In addition, in this embodiment, the mounting bracket 800 may be embodied in a structural form of the bent member shown in FIG. 8, but it is not limited thereto, and it may be arranged in any other form, such as a block structure or the like, as long as the reliable connection between the air deflector 300 and the skeletal front plate 200 and the reliable fixation of the switch component 500 to the mounting bracket 800 can be achieved by the mounting bracket 800 arranged in such a structural form.

Figure 12:
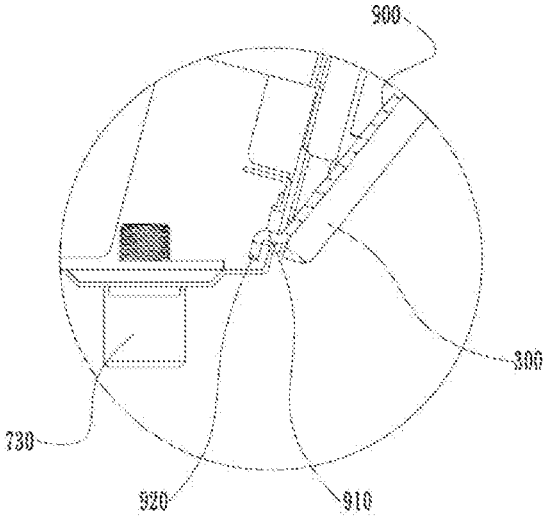
FIG. 12 is a partially enlarged view of portion D in FIG. 10.
Figure 13:
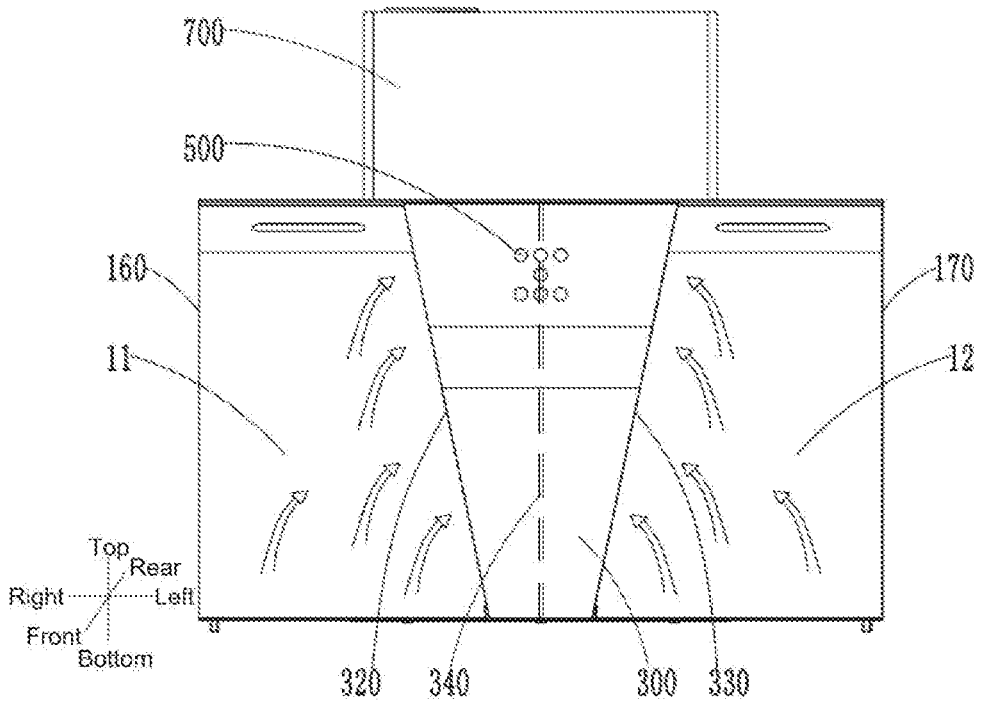
FIG. 13 is a schematic structural front view of another range hood according to an embodiment of the present disclosure.
Figure 14:
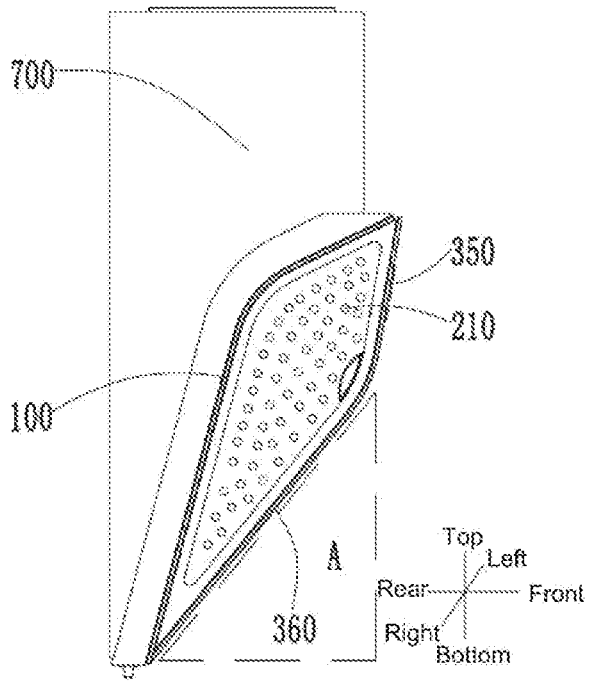
FIG. 14 is a schematic structural left view of the range hood in FIG. 13.

Continuing referring to FIG. 7, FIG. 8, and FIG. 10, in this embodiment, the range hood may further comprise a locking member 900 fixedly arranged at the bottom of the air deflector 300. As shown in FIG. 12, the locking member 900 comprises an overlapping edge 910. Specifically, the overlapping edge 910 is arranged at an angle from the air deflector 300, and the locking member 900 extends into the notch of the fume gathering panel 100 and is overlapped onto the range hood body 700, so that the air deflector 300 is in overlapped fixation onto the range hood body 700.

In this embodiment, during mounting of the air deflector 300, firstly the air deflector 300 may be in overlapped fixation onto the range hood body 700 by using the locking member 900 arranged at the bottom thereof, and then the air deflector 300 is fixed to the skeletal front plate 200 by using the threaded connectors. Such fixation method in which the locking member 900 is used in combination with the threaded connectors involves a simple structure and an easy operation, which greatly improves the efficiency of mounting and detachment of the air deflector 300.

Continuing referring to FIG. 12, in this embodiment, the bottom of the range hood body 700 is bent inward to form a supporting edge. When the air deflector 300 is mounted to the range hood body 700, the overlapping edge 910 is in sufficient contact with the supporting edge. In such overlapping form in which the overlapping edge 910 is in surface-to-surface contact with the supporting edge, a slip phenomenon caused by line-to-surface contact is avoided to a certain extent, and the stability and reliability of the overlapped fixation are ensured.

Continuing referring to FIG. 12, in this embodiment, a guiding edge 920 is extended from the overlapping edge 910 towards the direction of the oil outlet 730 of the range hood body 700.

The guiding edge 920 is arranged not only to play a certain role in guiding the oil liquid accumulated on the skeletal front plate 200 so that the oil liquid can be reliably guided to the position of the oil outlet 730 for concentrated discharge and the oil path structure is optimized well, but also to avoid, to a certain extent, the outflow of the oil liquid from the gap between the bottom of the air deflector 300 and the range hood body 700 and reduce overflow of the oil liquid so as to reduce the contamination of the surrounding environment caused by the range hood of this embodiment and to further improve the user experience. In addition, the guiding edge 920 is further arranged such that the air deflector 300 can be engaged with the supporting edge at the bottom of the range hood body 700, which further ensures a connection reliability between the air deflector 300 and the range hood body 700.

Continuing referring to FIG. 10, in this embodiment, the range hood may further comprise a centrifugal fan for discharging the oil fumes. Specifically, the air duct 720 of the centrifugal fan is provided with bottom holes of the air duct, so that the oil liquid in the air duct 720 can drip onto the inner surface of the fume gathering panel 100 through the bottom hole of the air duct, and then flow to the oil outlet 730 along the inner surface of the fume gathering panel 100.

In this embodiment, the oil receptacle 600 is arranged directly under the oil outlet 730.

When the range hood is working, exhaust gas generated by combustion at the gas stove and oil fumes generated during cooking are driven by the impeller 710 to enter through the first air inlet 210 and the second air inlet 220 and are filtered and separated by the filter screens 17, and then one part of the oil liquid is obstructed by the fume gathering panel 100 and drips onto the skeletal front plate 200 and is further directed to the locking member 900 along the inner surface of the skeletal front plate 200, and flows to the oil outlet 730 while being guided by the guiding edge 920; the other part of the oil liquid that rises upward into the air duct 720 through the fume collecting port 110 drips from the bottom hole of the air duct onto the fume gathering panel 100 and the skeletal front panel 200, wherein the oil liquid dripping onto the fume gathering panel 100 flows to the oil outlet 730 along the fume gathering panel 100, and the oil liquid dripping onto the skeletal front plate 200 flows to the oil outlet 730 along the skeletal front plate 200. After all of the oil liquids described above are gathered, they flow out through the oil outlet 730 into the oil receptacle 600 outside the range hood.

As shown in FIG. 13 to FIG. 16, this embodiment also provides a range hood, comprising a range hood body 700, a fume gathering panel 100, and a fume-collection and air-intake structure. Specifically, the fume-collection and air-intake structure is configured in a form of protruding from rear to front, a hollow portion is formed in the protrusion, and a first air inlet 210 and a second air inlet 220 communicating with the hollow portion are provided on the left and right sides of the protrusion. The range hood body 700 is connected to the fume-collection and air-intake structure for collecting fumes entering the hollow portion and then discharging the fumes to the outside. The fume gathering panel 100 comprises a left fume guiding portion 170 and a right fume guiding portion 160, and the left fume guiding portion 170 and the right fume guiding portion 160, from bottom to top, are inclined from rear to front. The generated oil fumes rise upward along the left fume guiding portion 170 and the right fume guiding portion 160 during ascending, and are obstructed by the protrusion in the middle of the fume-collection and air-intake structure to achieve a better fume gathering effect, and the oil fumes are sucked directly into the hollow portion from the air inlets arranged on the left and right sides of the protrusion portion of the fume-collection and air-intake structure and then are discharged from the range hood body 700 to the outside, so that escape of the oil fumes is reduced, and better fume gathering and discharging effects are achieved.

Specifically, both sides of the fume-collection and air-intake structure are inclined from the center towards both sides from bottom to top, so that the spaces of a left fume gathering region 12 and a right fume gathering region 11 are gradually narrowed from bottom to top so as to form a positive pressure region at the upper part. Since both sides of the fume-collection and air-intake structure are inclined from the center towards both sides from bottom to top, the left fume gathering region 12 and the right fume gathering region 11 each have a larger lower space and a smaller upper space. While the fumes are rising upward, the air pressure gradually increases. When the range hood activates ventilation, a negative pressure is formed in the hollow portion of the fume-collection and air-intake structure, and there will be a larger pressure difference between the oil fumes under positive pressure in the fume gathering region and the air at negative pressure in the hollow portion, so that the oil fumes will be more quickly introduced into the hollow portion through the first air inlet 210 and the second air inlet 220 and then discharged.

Specifically, the fume-collection and air-intake structure comprises a left air intake plate 330 and a right air intake plate 320 both connected to the fume gathering panel 100, and an air deflector 300 connected to the left air intake plate 330 and the right air intake plate 320, wherein the left air intake plate 330, the right air intake plate 320, and the air deflector 300 constitute the outline of the fume-collection and air-intake structure, the first air inlet 210 is provided on the right air intake plate 320, and the second air inlet 220 is provided on the left air intake plate 330. The air deflector 300 comprises an upper plate 350 and a lower plate 360, the lower plate 360, from bottom to top, is inclined from rear to front, and a curved convex portion is located between the upper plate 350 and the lower plate 360. In this way, a visually unobstructed region A is formed under the lower plate 360 to reduce or even avoid visual obstructions which may hinder the user from observing the cooking state in a cooking utensil under the range hood, thus it is convenient for the user to see the cooking utensils in both left and right regions at the same time, and visual discomfort is reduced.

In this embodiment, the switch component 500 is arranged on the upper plate 350. Specifically, the upper plate 350 is arranged vertically, or the upper plate 350, from bottom to top, is inclined from rear to front at an angle $\alpha$, less than 15°, from the vertical plane. After the range hood is normally mounted, the height of the air deflector 300 from the ground is between 1.4 and 1.65 meters, and is at the same level as the height of the eyes of most users from the ground as a whole. Moreover, observation and manipulation are facilitated by mounting the switch component 500 on the upper plate 350.

In this embodiment, an angle $\beta$ between the lower plate 360 and the vertical plane satisfies $30° \leq \beta \leq 45°$. Specifically, the angle $\beta$ may be selected from 35°, 38°, 42°, or the like. This is because the user is closer to the range hood during the cooking operation. When the user looks downward, if the angle is less than 30°, the user's sight is easily obstructed, the user needs to stay away from the range hood to facilitate observation, and thus the user experience is affected; and if the angle is greater than 45°, the effective distribution of air inlets in the fume suction region is affected, the area of the air inlets is reduced, and thus the fume suction effect is affected.

Specifically, in this embodiment, the upper plate 350 and the lower plate 360 are integrally formed, wherein the lower width W1 of the lower plate 360 satisfies 80 mm≤W1≤150 mm, and the upper width W2 of the upper plate 350 satisfies 280 mm≤W2≤400 mm. Such arrangement not only allows the hollow portion to have enough accommodating space, but also ensures the space of the fume gathering region, so that they are coordinated with each other, the fume gathering effect of the fume gathering region and the fume suction effect of the hollow portion are effectively balanced, and thereby the oil fume discharge capability of the range hood of this embodiment is ensured.

Figure 15:
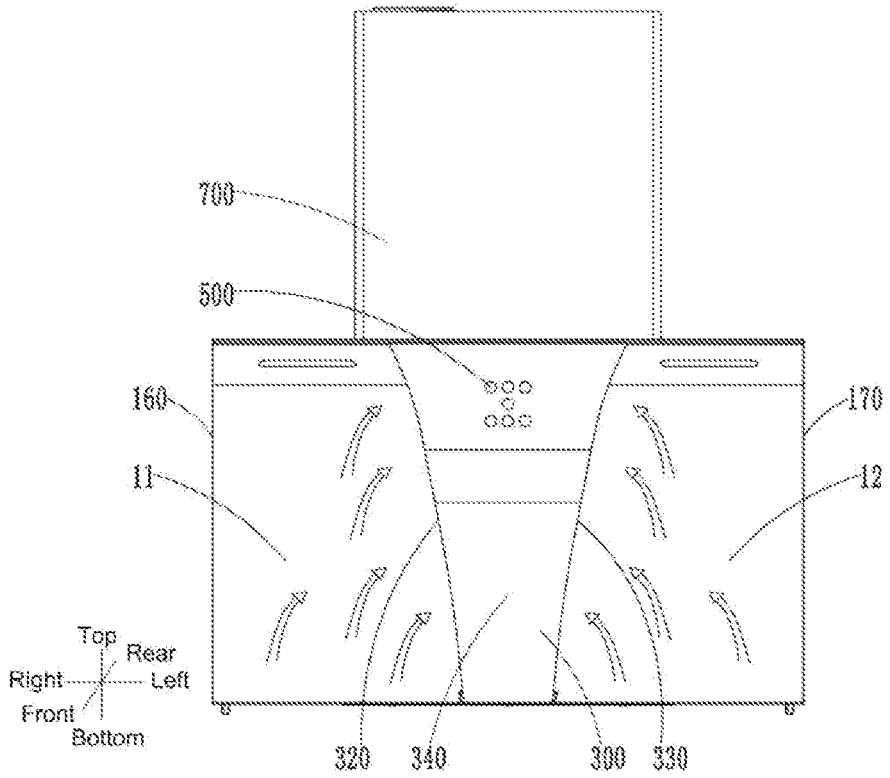
FIG. 15 is a schematic structural front view of still another range hood according to an embodiment of the present disclosure (with a different central arc)

In another specific embodiment, as shown in FIG. 15, the difference is that the left air intake plate 330 and the right air intake plate 320 have curved surfaces or arcuate surfaces. Such arrangement increases the distribution area of the first air inlet 210 and the second air inlet 220 to a certain extent so as to further improve the oil fume suction effect of the range hood of this embodiment.

Figure 16:
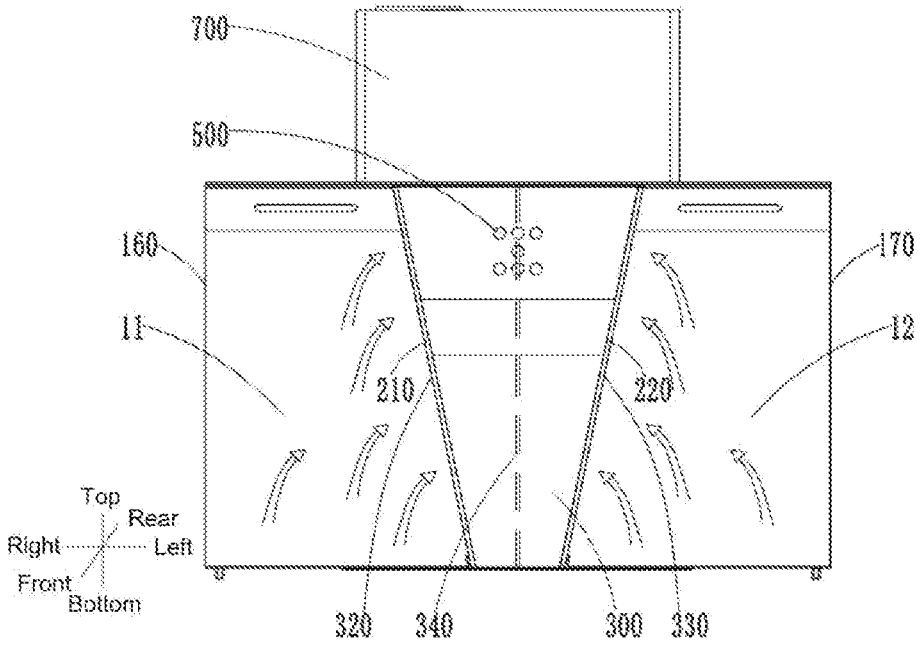
FIG. 16 is a schematic structural front view of yet another range hood according to an embodiment of the present disclosure (with left and right air intake plates arranged at a different angle)

In still another specific embodiment, as shown in FIG. 16, the left air intake plate 330 is inclined from right to left and from rear to front, and the right air intake plate 320 is inclined from left to right and from rear to front. Such arrangement effectively increases the air intake area, so that the spaces of the left fume gathering region 12 and the right fume gathering region 11 are gradually narrowed from bottom to top, and thus the fume gathering capability is gradually enhanced. Moreover, the first air inlet 210 and the second air inlet 220 are provided towards a direction where the fumes ascend, whereby the oil fume suction effect of the range hood of this embodiment is further enhanced.

In addition, in this embodiment, filter screens 17 arranged at the first air inlet 210 and the second air inlet 220 may be detachably fixedly connected to the range hood body 700. Such arrangement facilitates cleaning and maintenance of the filter screens by the user while achieving filtration of grease from oil fumes to reduce environmental contamination.

Specifically, in this embodiment, the range hood further comprises a partition plate (also referred to as a sail-shaped plate) 340, which is placed in the hollow portion and divides the hollow portion into a left chamber and a right chamber. The partition plate 340 is arranged to ameliorate or even avoid the reduction of the fume suction effect due to mutual interference between oil fumes sucked from the air inlets on the left and right sides, thereby ensuring an operational reliability of the range hood of this embodiment. Further, the partition plate 340 can be driven by an external force to slide or swing to change the spatial sizes of the left chamber and the right chamber. Such arrangement allows the user to adjust the sizes of the left chamber and the right chamber according to the fume conditions in the left and right fume gathering regions 11 and 12, so that when the left fume gathering region 12/the right fume gathering region 11 has a larger amount of fumes, the partition plate 340 is slid or swung to increase the space of the left chamber/right chamber so as to increase the air intake volume in the left chamber/right chamber, so that the fumes are exhausted quickly from the left fume gathering region 12/right fume gathering region 11.

Figure 17:
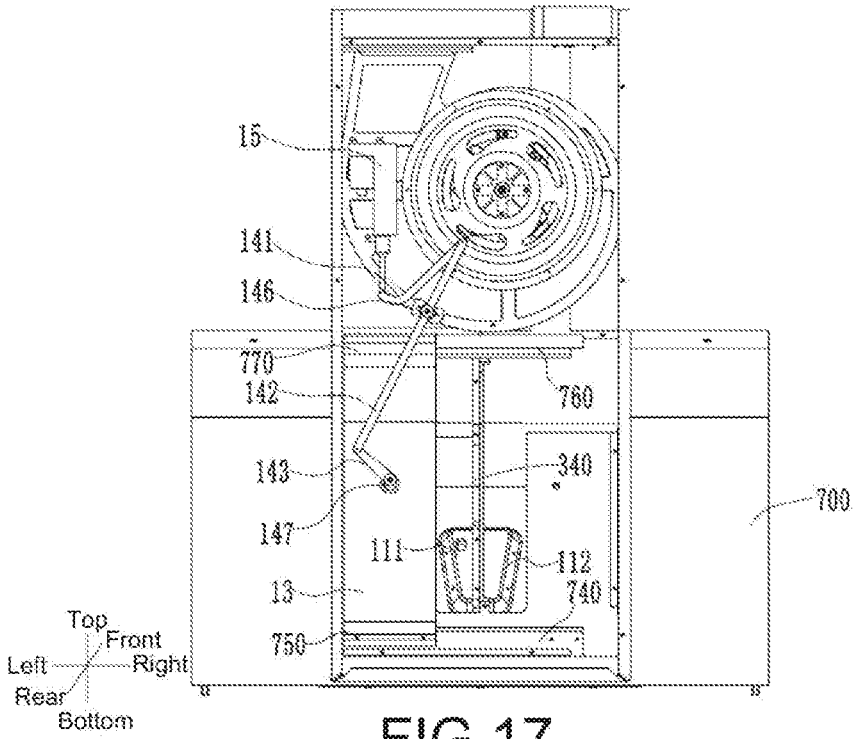
FIG. 17 is a schematic rear view showing the internal structure of a further range hood according to an embodiment of the present disclosure, wherein a blocking member incompletely blocks a right fume collecting port.
Figure 18:
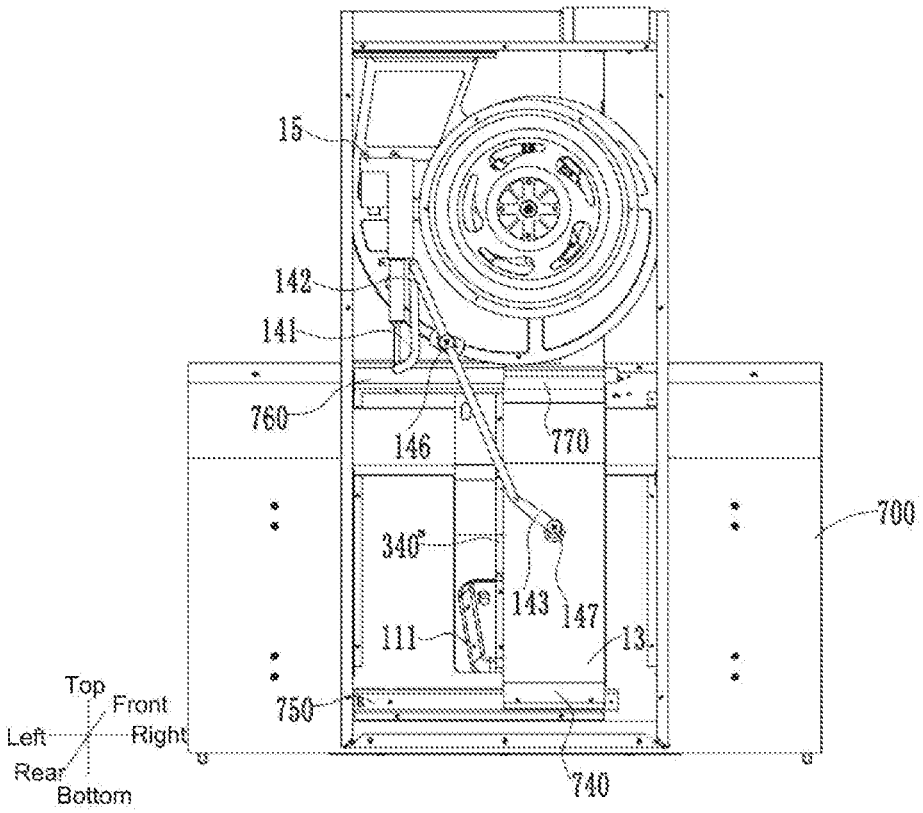
FIG. 18 is a schematic rear view showing the internal structure of the range hood shown in FIG. 17 when the blocking member completely blocks a left fume collecting port.
Figure 19:
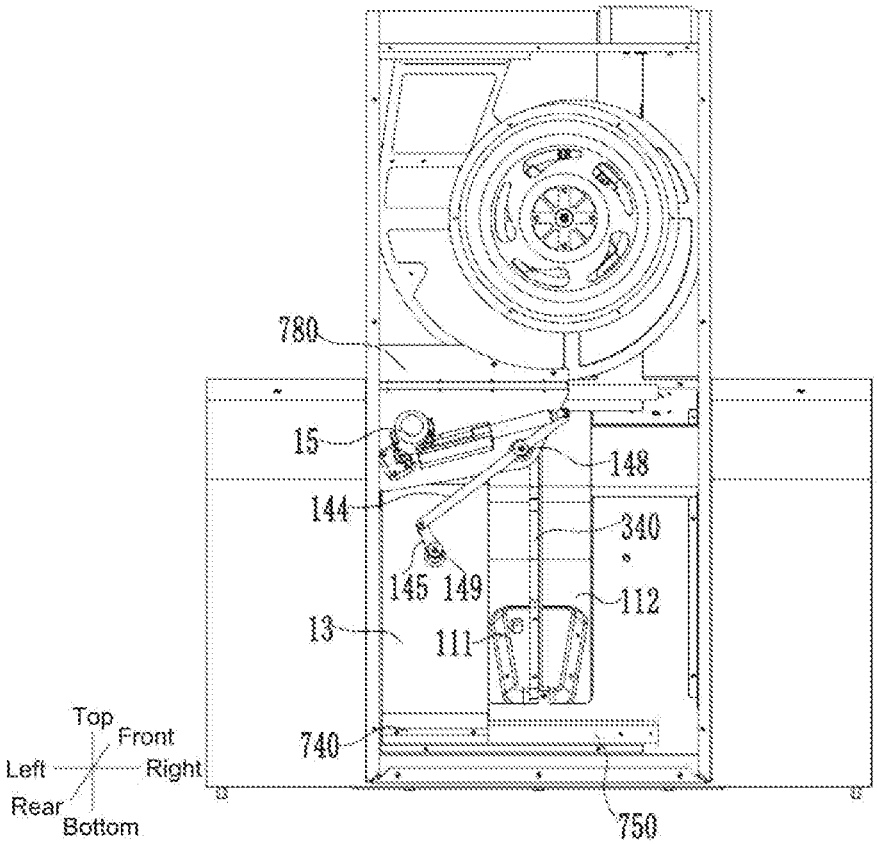
FIG. 19 is a schematic rear view showing the internal structure of a still further range hood according to an embodiment of the present disclosure, wherein a blocking member incompletely blocks a right fume collecting port.

This embodiment also provides a range hood. As shown in FIG. 17 to FIG. 19, the range hood comprises a range hood body 700, and a fume gathering panel 100 of the range hood body 700 is sequentially provided with a first air inlet 210 and a second air inlet 220 along its length direction, wherein the first air inlet 210 is located at the right half of the fume gathering panel 100, and the second air inlet 220 is located at the left half of the fume gathering panel 100. A blocking member 13 and a driving device (also referred to as a driving component) 14 are arranged in the range hood body 700, and the driving device 14 is configured for driving the blocking member 13 to block the first air inlet 210 or the second air inlet 220.

The range hood according to this embodiment comprises a range hood body 700 for gathering oil fumes generated during cooking with left and right burners on a cooktop, a first air inlet 210 and a second air inlet 220 from which the oil fumes are sucked into the range hood body 700, a blocking member 13 for blocking the first air inlet 210 and the second air inlet 220 to control the fume suction and purification intensities on the left and right sides, and a driving device 14 for driving the movement of the blocking member 13. The first air inlet 210 or the second air inlet 220 is blocked by the blocking member 13 to change its effective ventilation area so as to adjust the magnitude of a suction force applied by a fan system to oil fumes entering the first air inlet 210 and the second air inlet 220, as the magnitude of the suction force generated by the fan system or other suction force generating device is proportional to the ventilation area of the air inlet.

The first air inlet 210 is arranged at the right half of the fume gathering panel 100, and is closer to the right burner on the cooktop as compared with the case where it is arranged in the middle of the fume gathering panel 100; similarly, the second air inlet 220 is arranged at the left half of the fume gathering panel 100, and is closer to the left burner on the cooktop as compared with the case where it is arranged in the middle of the fume gathering panel 100. Under the same wind power, the synergism of the first air inlet 210 and the second air inlet 220 has a better effect of sucking and purifying oil fumes generated by the left and right burners than a single air inlet arranged in the middle.

During cooking, when the left burner and the right burner generate the same amount of oil fumes, the driving device 14 may drive to a position that does not affect the intake of air into the first air inlet 210 and the second air inlet 220, for example, the space on the right side of the first air inlet 210 or the space on the left side of the second air inlet 220 in the range hood body 700, and oil fumes outside the range hood body 700 are sucked by the suction force generated by the fan system or other air suction device through the first air inlet 210 and the second air inlet 220 into the range hood body 700, and further delivered into the public flue to be treated. When the amount of oil fumes generated by the left burner is larger than the amount of oil fumes generated by the right burner during cooking, the driving device 14 is activated and the driving device 14 is controlled to move the blocking member 13 along the length direction of the fume gathering panel 100 to block the first air inlet 210. The specific area to be blocked may be adjusted according to the difference between the amounts of oil fumes from the left and right burners. For example, if the amount of oil fumes generated by the right burner is zero, the driving device 14 drives the blocking member 13 to completely block the first air inlet 210; if the amount of oil fumes generated by the right burner is half that generated by the left burner, the driving device 14 blocks a half area of the first air inlet 210, and the area to be blocked may be adjusted in a similar method in other cases. When the suction force generated by the fan system is unchanged, if the ventilation area of the second air inlet 220 is reduced and the ventilation area of the first air inlet 210 is unchanged, the suction force generated in the second air inlet 220 is greater than that generated in the first air inlet 210, and accordingly, the second air inlet 220 has an enhanced effect of sucking and purifying the oil fumes from the left burner such that the suction of a large amount of oil fumes from the left side is completed, and the first air inlet 210 with a smaller suction force can also allow the suction and purification of the oil fumes generated by the right burner. Specifically, when the right burner does not generate any oil fumes, the blocking member 13 completely blocks the first air inlet 210, and the effective volume of air through the second air inlet 220 can be effectively increased by more than 70%. Furthermore, since the total ventilation area is reduced, the suction force generated by the fan system is decreased, and hence noise is also decreased slightly. When the amount of oil fumes generated by the right burner is greater than that from the left burner, the adjustment method is similar to the method described above, and therefore will not be described in detail herein.

The ventilation areas of the left fume collecting port 111 and the right fume collecting port 112 are adjusted by the blocking member 13 to properly distribute the forces for suction of oil fumes from the left and right sides, so that the oil fumes generated by the stoves on the left and right sides can be sucked cleanly in the case where the fan system generates a constant suction force, and hence the oil fume suction effect and efficiency of the range hood are improved. Furthermore, the first air inlet 210 and the second air inlet 220 are respectively located at a shorter distance from the left burner and the right burner than a single air inlet arranged in the middle of the fume gathering panel 100, so that loss of wind power is reduced, and the oil fume suction and purification effects are further improved.

In this embodiment, as shown in FIG. 17 to FIG. 19, a first guide member 740 may be arranged inside the range hood body 700 along its length direction, a first stopper 750 may be arranged at the bottom of the blocking member 13, and the first stopper 750 is slidably connected to the first guide member 740.

The blocking member 13 is driven by the driving device 14 to slide along the first guide member 740, and the first stopper 750 serves the function of limiting and guiding the stroke of the blocking member 13, thereby improving the accuracy of the position of the blocking member 13 driven by the driving device 14, and also correspondingly improving the effect of blockage of the first air inlet 210 or the second air inlet 220 by the blocking member 13 so as to ensure an accurate control of the air volume by the blocking member 13.

In order to further improve the effect of guiding the stroke of the blocking member 13, in this embodiment, a second guide member 760 may also be arranged inside the range hood body 700 along its length direction, a second stopper 770 may be arranged at the top of the blocking member 13, and the second stopper 770 is slidably connected to the second guide member 760.

Specifically, the first guide member 740 may be a guide rail, and the first stopper 750 is a sliding groove which is fitted with and slidably connected to the guide rail; or alternatively, the first guide member 740 is a sliding groove, and the first stopper 750 is an engaging element which is engaged into the sliding groove and is slidably connected to the sliding groove. The second guide member 760 and the second stopper 770 may also have the structures described above, and will not be described in detail herein.

Figure 20:
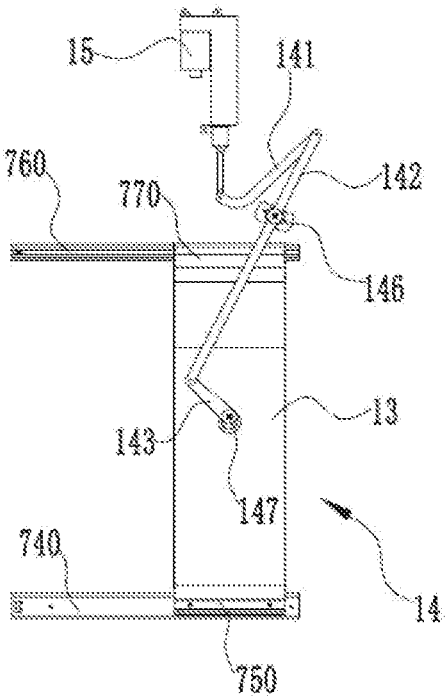
FIG. 20 is a schematic view showing a connection structure between a driving device and the blocking member in FIG. 18.

Specifically, in this embodiment, as shown in FIG. 17, FIG. 18, and FIG. 20, the driving device 14 may comprise a driving member 15, a first connecting rod 141, a second connecting rod 142 and a third connecting rod 143. A first pivot joint 146 is arranged in the range hood body 700, a second pivot joint 147 is arranged on the blocking member 13, a driving end of the driving member 15, the first connecting rod 141, the second connecting rod 142, and the third connecting rod 143 are sequentially hinged, and the driving member 15 is mounted in the range hood body 700, the second connecting rod 142, at its position close to the first connecting rod 141, is pivotably connected to the first pivot joint 146, and a free end of the third connecting rod 143 is hinged to the second pivot joint 147. Here is described a specific structure of the driving device 14. The driving member 15 is fixed in the range hood body 700. Specifically, it may be fixed to the side wall of the range hood body 700 or to the fan system in the range hood body 700. When a stretchable portion of the driving member 15 is stretched, the first connecting rod 141 drives the second connecting rod 142 to rotate counterclockwise about the first pivot joint 146, and the third connecting rod 143 drives the blocking member 13 to move rightwards along the first guide member 740 and the second guide member 760. Conversely, when the stretchable portion of the driving member 15 is retracted, the connecting rod mechanism drives the blocking member 13 to move leftwards. The position of the blocking member 13 may be controlled by controlling the length of the stretchable portion of the driving member 15 so as to achieve the blockage of the first air inlet 210 and the second air inlet 220 by the blocking member 13.

As an alternative to the above-mentioned structure of the driving device 14, in this embodiment, as shown in FIG. 19, the driving device 14 may comprise a driving member 15, a fourth connecting rod 144, and a fifth connecting rod 145. A third pivot joint 148 is arranged in the range hood body 700, a fourth pivot joint 149 is arranged on the blocking member 13, a driving end of the driving member 15, the fourth connecting rod 144, and the fifth connecting rod 145 are sequentially hinged, and the driving member 15 is pivotably connected in the range hood body 700, the fourth connecting rod 144, at its position close to the driving member 15, is pivotably connected to the third pivot joint 148, and a free end of the fifth connecting rod 145 is hinged to the fourth pivot joint 149. Specifically, a fixing frame 780 may be arranged in the range hood body 700, the driving member 15 is pivotably connected to the fixing frame 780, and the third pivot joint 148 is fixedly arranged on the fixing frame 780. When the stretchable portion of the driving member 15 is stretched, the fourth connecting rod 144 rotates clockwise about the third pivot joint 148, and at the same time, the fifth connecting rod 145 drives the blocking member 13 to move leftwards along the first guide member 740. Correspondingly, when the stretchable portion of the driving member 15 is retracted, the connecting rod mechanism drives the blocking member 13 to move rightwards.

In this embodiment, a fume collecting port 110 may be provided in the middle of the fume gathering panel 100, the fume collecting port 110 is externally covered with a skeletal front plate 200, the skeletal front plate 200 partitions the range hood body 700 into a left fume gathering chamber and a right fume gathering chamber, the first air inlet 210 is provided on the right side surface of the skeletal front plate 200, and the second air inlet 220 is provided on the left side surface of the skeletal front plate 200. A partition plate 340 is arranged on the skeletal front plate 200, the partition plate 340 partitions the fume collecting port 110 into a left fume collecting port (also referred to as a left fume port) 111 and a right fume collecting port (also referred to as a right fume port) 112, and the blocking member 13 is driven by the driving device 14 to block the left fume collecting port 111 or the right fume collecting port 112. Specifically, the shape of the partition plate 340 may match that of the skeletal front plate 200. The partition plate 340 partitions the interior of the range hood body 700 into two independent oil fume passages, wherein the first air inlet 210 communicates with the right fume collecting port 112, and the second air inlet 220 communicates with the left fume collecting port 111. The partition plate 340 partitions the fume gathering panel 100 into two relatively independent fume gathering chambers, and separates the oil fumes generated by the left and right burners from each other. The first air inlet 210 and the second air inlet 220 work independently of each other. When the range hood is working, the fan system generates a suction force, such that the oil fumes in the left fume gathering chamber are sucked through the second air inlet 220 and the left fume collecting port 111 into the range hood body 700, and the oil fumes in the right fume gathering chamber are sucked through the first air inlet 210 and the right fume collecting port 112 into the range hood body 700. The blocking member 13 blocks the left fume collecting port 111 and the right fume collecting port 112 to achieve the control of the ventilation areas of the first air inlet 210 and the second air inlet 220 so as to achieve the control of the magnitudes of the suction forces applied to the oil fumes on the left and right sides.

In addition, the partition plate 340 may be arranged to reduce the cross-mixing of the oil fumes generated by the left burner with the oil fumes generated by the right burner, which is not conducive to the control of the purification states in the first air inlet 210 and the second air inlet 220. In this embodiment, the shape of the partition plate 340 matches the shape of the skeletal front plate 200, thus, relatively good sealing is achieved between the partition plate 340 and the skeletal front plate 200, and the partition plate 340 partitions the interior of the skeletal front plate 200 into two relatively independent oil fume passages so as to reduce the leakage of the suction force applied to oil fumes on either side of the partition plate 340 from the gap between the partition plate 340 and the skeletal front panel 200 into the neighboring fume passage when the fan system is working, which would affect the control of the suction forces on the left and right sides. Thus, the adjustment of the suction forces on the left and right sides by the blocking member 13 is further improved.

In this embodiment, a sealing strip may be arranged at an edge of the partition plate 340 that is in contact with the skeletal front plate 200, in order to ensure the sealing between the partition plate 340 and the skeletal front plate 200.

Figure 21:
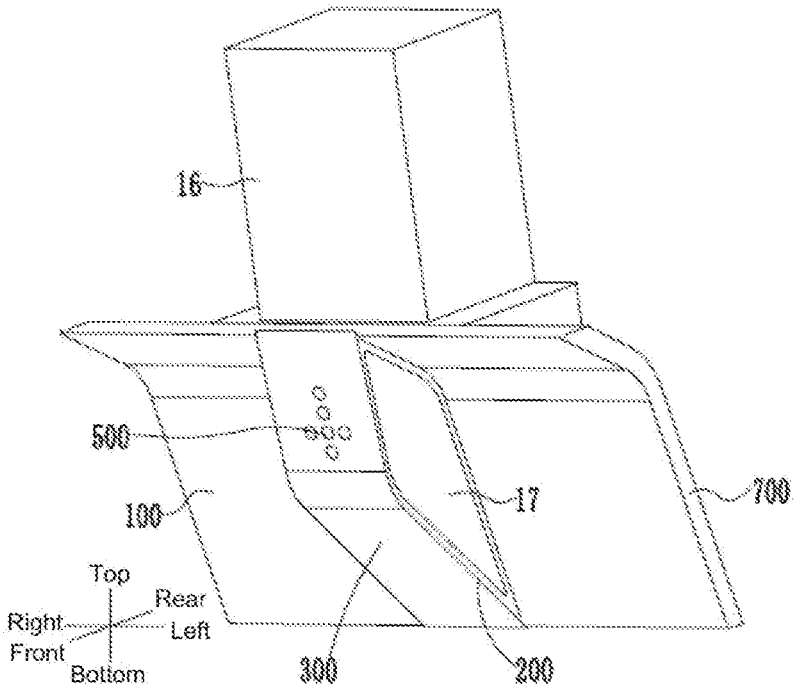
FIG. 21 is a schematic structural view of a yet further range hood according to an embodiment of the present disclosure.
Figure 22:
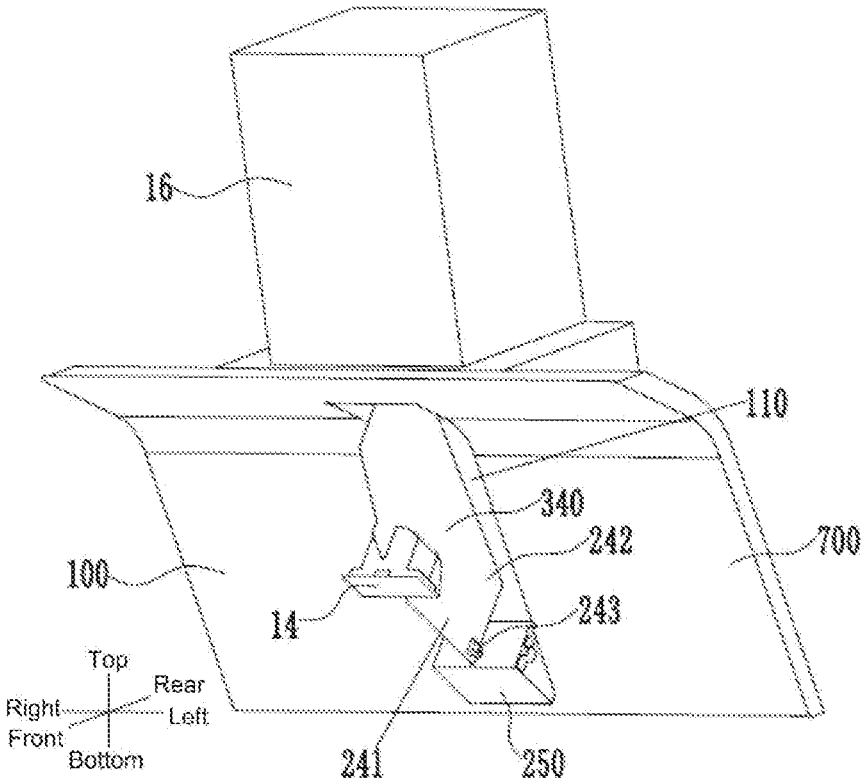
FIG. 22 is a schematic structural view of the range hood in FIG. 21 from which a skeletal front plate is removed.
Figure 23:
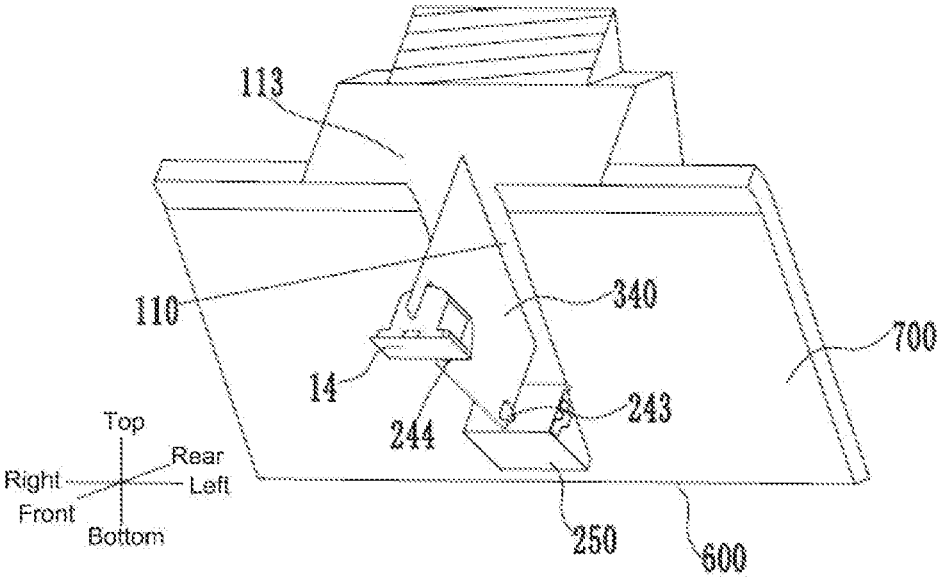
FIG. 23 is a schematic internal structural view of the range hood in FIG. 21.

This embodiment also provides a range hood. As shown in FIG. 21 to FIG. 23, a fume collecting port 110 is provided in the middle of the fume gathering panel 100 of the range hood body 700, a fume outlet 113 is provided on the top plate of the range hood body 700, and the fume outlet 113 communicates with the fume collecting port 110. A skeletal front plate 200 is arranged outside the fume collecting port 110, the skeletal front plate 200 partitions the range hood body 700 into a left fume gathering chamber and a right fume gathering chamber, a left fume collecting port 111 and a right fume collecting port 112 are provided on the left and right side surfaces of the skeletal front plate 200, respectively, a partition plate 340 is pivotably connected in a hollow portion formed between the air deflector 300 and the fume gathering panel 100, and the partition plate 340 is inserted into the fume collecting port 110 to partition the fume collecting port 110 into two, left and right, passage ports.

The range hood with a partition plate 340 described above comprises a range hood body 700 for collecting oil fumes. The range hood body 700 is provided with a skeletal front plate 200 for partitioning the range hood body into two, left and right, independent fume collecting spaces. The skeletal front plate 200 is provided therein with a partition plate 340 for partitioning the interior of the skeletal front plate 200 into two passages, and the partition plate 340 may partition the fume collecting port 110 into two, left and right, passage ports. The sizes of the two passage ports can be adjusted with a rotation of the partition plate 340 so as to adjust the magnitudes of suction forces applied by a fan system to oil fumes in the left fume collecting port 111 and the right fume collecting port 112, as the magnitude of the suction force generated by the fan system or other suction force generating device is proportional to the ventilation area of the air duct port.

Specifically, the two opposite sides of the partition plate 340 may be provided as a pivoting portion 241 and a partitioning portion 242, respectively, wherein the pivoting portion 241 is pivotably connected to the skeletal front plate 200 or the range hood body 700, and the partitioning portion 242 is inserted into the fume collecting port 110 to partition the fume collecting port 110 into two, left and right, passage ports. When in use, the range hood is mounted at a corresponding position above the cooktop. When the left stove and the right stove on the cooktop generate the same amount of oil fumes during cooking, the pivoting portion 241 of the partition plate 340 is rotated, the partitioning portion 242 of the partition plate 340 is rotated therewith, and the partitioning portion 242 of the partition plate 340 is adjusted to the middle of the fume collecting port 110 such that the partition plate 340 partitions the left and right sides of the fume collecting port 110 into two passage ports with equal ventilation area, and then the fan system is activated and the fan system generates a strong suction force such that the oil fumes outside the range hood body 700 are introduced into the range hood body 700 under the suction force, and conveyed through the fume outlet 113 to a designated position for treatment or emission. Specifically, the oil fumes generated on the left stove move upwards, enter through the left fume collecting port 111, and are sucked by the fan system into the range hood body 700 through the passage port on the left side of the fume collecting port 110 along the partition plate 340, and are discharged from the range hood body 700 through the fume outlet 113. Similarly, the oil fumes generated on the right stove are sucked by the fan system so as to be discharged from the range hood body 700 sequentially through the right fume collecting port 112, the passage port on the right side of the fume collecting port 110, the range hood body 700, and the fume outlet 113. Since the partition plate 340 partitions the fume collecting port 110 into two passage ports with the same size, the fan system generates the same suction force for the two passage ports, and the oil fumes in the left fume gathering chamber and the right fume gathering chamber are sucked through the left fume collecting port 111 and the right fume collecting port 112 under equal suction forces.

When the left stove and the right stove generate different amounts of oil fumes, a case where the left stove generates a larger amount of oil fumes is described as an example. In this case, the partition plate 340 is rotated rightwards, the partitioning portion 242 of the partition plate 340 is rotated therewith such that the passage port on the left side of the fume collecting port 110 has a larger ventilation area than that of the right passage port, and then the fan system is activated. The fan system generates a larger suction force for the left passage port than for the right passage port, and correspondingly, the left fume collecting port 111 provides a larger force for sucking oil fumes from the left fume gathering chamber such that the suction of a large amount of oil fumes from the left side is completed, and the suction of oil fumes from the right side can also be completed by the right fume port which provides a smaller force for sucking oil fumes from the right fume gathering chamber. Thus, when the amount of oil fumes generated by the left stove is larger than the amount of oil fumes generated by the right stove, the angle of the partition plate 340 is adjusted to adjust the sizes of the two passage ports into which the fume collecting port 110 is partitioned by the partition plate 340 so as to properly distribute the suction forces applied to the oil fumes on the left and right sides, so that the oil fumes generated by the stoves on the left and right sides can be sucked cleanly in the case where the fan system generates a constant suction force, and hence the oil fume suction effect and efficiency of the range hood are improved.

In this embodiment, as shown in FIG. 22, the shape of the partition plate 340 may match that of the skeletal front plate 200, and the partition plate 340 partitions the interior of the skeletal front plate 200 into two independent oil fume passages. The shape of the partition plate 340 matches the shape of the skeletal front plate 200, thus, relatively good sealing is achieved between the partition plate 340 and the skeletal front plate 200, and the partition plate 340 partitions the interior of the skeletal front plate 200 into two relatively independent oil fume passages so as to reduce the leakage of the suction force applied to oil fumes on either side of the partition plate 340 from the gap between the partition plate 340 and the skeletal front panel 200 into the neighboring fume passage when the fan system is working, which would affect the control of the suction forces on the left and right sides. Thus, the adjustment of the magnitudes of the suction forces on the left and right sides by the angular rotation of the partition plate 340 is further improved. A sealing strip may be arranged at an edge of the partition plate 340 that is in contact with the skeletal front plate 200, in order to ensure the sealing between the partition plate and the skeletal front plate 200 during the rotation of the partition plate 340.

In this embodiment, as shown in FIG. 21 to FIG. 23, the skeletal front plate 200 may comprise a base, the partition plate 340 is pivotably connected to the base, a driving device 14 is mounted to the inner side wall of the air deflector 300, the driving device 14 is configured for driving the rotation of the partition plate 340, a switch component 500 of the range hood is arranged on the outer side wall of the air deflector 300, and the switch component 500 is electrically connected to the driving device 14.

Specifically, the switch component 500 may comprise a left steering switch and a right steering switch. The driving device 14 may drive the rotation of the partition plate 340 so as to change the sizes of the passage ports on both sides of the partitioning portion 242 of the partition plate 340 to adjust the magnitudes of the suction forces in the left fume gathering chamber and the right fume gathering chamber. When the left stove generates a larger amount of oil fumes during use, the right steering switch is pressed, the driving device 14 drives the partition plate 340 to rotate rightwards, and the partitioning portion 242 of the partition plate 340 rotates rightwards therewith, such that the passage port of the fume collecting port 110 located on the left side of the partition plate 340 has an increased area and the right passage port has a decreased area. After the partition plate 340 is rotated by a certain angle, the right steering switch is turned off to complete the angular adjustment of the partition plate 340. The fan system is activated, a larger suction force is generated for the left passage port in the fume collecting port 110, and correspondingly, the left fume collecting port 111 provides a larger force for sucking oil fumes from the left fume gathering chamber, and the right fume collecting port 112 provides a smaller force for sucking oil fumes from the right fume gathering chamber. Similarly, when the right stove generates a larger amount of oil fumes, the left steering switch is pressed to control the partition plate 340 to rotate leftwards. Details thereof are omitted here. The driving device 14 is arranged not only to improve the operational convenience in the control of the angle of the partition plate 340, but also to allow high accuracy and sensitivity in electrical control.

It should be noted that, in this embodiment, the switch component 500 may be arranged in the form of buttons 510, but it is not limited thereto, and other forms such as a touch switch may also be used, as long as the automatic control of the range hood can be achieved by the switch component 500 arranged in such a form.

In this embodiment, an oil fume sensor may be arranged on the range hood body 700, the oil fume sensor is electrically connected with a microprocessor, the microprocessor is electrically connected with a driving device 14, and the driving device 14 is configured for driving the rotation of the partition plate 340. The oil fume sensor monitors the amounts of oil fumes in the left fume gathering chamber and the right fume gathering chamber of the range hood body 700. When the oil fume sensor senses that the left fume gathering chamber has a larger amount of oil fumes, an electric signal may be transmitted to the microprocessor, the microprocessor receives the electrical signal and calculates a direction in which the partition plate 340 is to be rotated and an angle by which the partition plate is to be rotated, and transmits the control signal to the driving device 14, and the driving device 14 is activated to drive the partition plate 340 to rotate rightwards by a certain angle and then stop rotating, such that the adjustment of the size of the passage port by the partition plate 340 is completed. When the right fume gathering chamber has a larger amount of oil fumes, the working principle is similar, and therefore will not be described in detail herein.

The oil fume sensor is provided with both high sensitivity and high accuracy, and a real-time adjustment can be performed according to the amount of oil fumes, which greatly reduces the labor of the operator.

Figure 24:
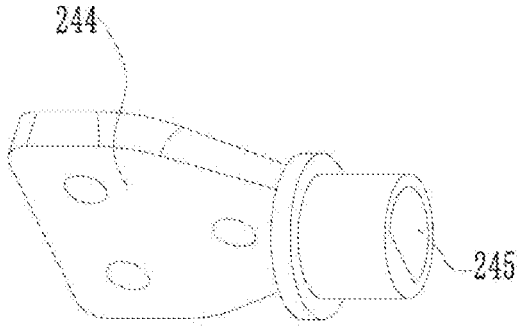
FIG. 24 is a schematic structural view of a second pivot shaft in FIG. 23.

In this embodiment, as shown in FIG. 22 to FIG. 24, the partition plate 340 is provided with an accommodating groove matching the driving device 14, a first pivot shaft 243 is arranged at the bottom of the partition plate 340, and the base is provided with a pivoting groove matching the first pivot shaft 243; a second pivot shaft 244 is arranged at the bottom of the accommodating groove, a free end surface of the second pivot shaft 244 is provided with an engaging groove 245, and the engaging groove 245 matches the output end of the driving device 14. Here is described a specific form in which the driving device 14 and the partition plate 340 are connected. The driving device 14 is fixed to the skeletal front plate 200, and the output end of the driving device 14 is engaged into the engaging groove 245 of the second pivot shaft 244, wherein the first pivot shaft 243 is coaxial with the second pivot shaft 244. When the switch component 500 is turned on, the output end of the driving device 14 is rotated and drives, through the engaging groove 245, the second pivot shaft 244 and the partition plate 340 to rotate about the first pivot shaft 243, thereby achieving the driving of the angular rotation of the partition plate 340 by the driving device 14. Specifically, a driving motor may be selected and used as the driving device 14 here.

It should be noted here that the configuration in which the driving device 14 drives the rotation of the partition plate 340 is not limited thereto, and any configuration capable of implementing the driving of the rotation of the partition plate 340 is possible.

In this embodiment, as shown in FIG. 21, a decorative cover 16 may be fixedly arranged on the upper part of the range hood body 700, and the decorative cover 16 covers the fume outlet 113 therein. The decorative cover 16 is arranged such that, on the one hand, the connection between the exhaust pipe and the range hood body 700 can be protected to reduce its damage caused by external factors which would affect the operating condition of the range hood, and on the other hand, the cleanliness of the appearance of the range hood can be enhanced to improve the user experience.

This embodiment also provides a central fume purification device, comprising a public flue and the range hood described above, wherein an exhaust pipe of the range hood communicates with the public flue.

The central fume purification device according to this embodiment comprises a range hood for extracting oil fumes from the kitchen and a public flue for conveying the oil fumes. Specifically, a plurality of range hoods may be provided, and the plurality of range hoods work independently of one another.

When in use, the range hood in the working state discharges the oil fumes extracted from the kitchen into the public flue through the exhaust pipe, and the public flue conveys the oil fumes collected by the plurality of range hoods to a subsequent purification device for treatment of the oil fumes. Here, this range hood used is provided with two, left and right, air inlets, each of which is located at a reduced distance from the corresponding burner, so that a good purification effect is achieved under the same wind power. Moreover, when the amount of oil fumes generated by the left burner is different from the amount of oil fumes generated by the right burner, the ventilation areas of the first air inlet 210 and the second air inlet 220 may be adjusted by the blocking member 13 to properly distribute the forces for suction of oil fumes from the left and right sides, so that the oil fumes generated by the stoves on the left and right sides can be sucked cleanly in the case where the fan system generates a constant suction force, and hence the oil fume suction effect and efficiency of the range hood are improved.

Finally, it should be noted that the above embodiments are merely intended to illustrate the technical solutions of the present disclosure, but not intended to limit the present disclosure. Although the present disclosure has been described in detail with reference to the foregoing embodiments, it should be understood by those of ordinary skill in the art that the technical solutions disclosed in the foregoing embodiments may still be modified, or some or all of the technical features thereof may be replaced with equivalents; and these modifications or replacements will not cause the essence of the corresponding technical solutions to depart from the scope of the technical solutions of the embodiments of the present disclosure.

INDUSTRIAL APPLICABILITY

The fume collecting assembly, the range hood, the side suction range hood, the range hood for two-sided fume collection and central air intake, the range hood with a partition, and the central fume purification device proposed in the present disclosure allow an increase in the air intake area, so that oil fumes generated during cooking can be discharged in time, thereby greatly ameliorating the situation that the prior range hood has an unsatisfactory fume suction effect, reducing the arbitrary flow of oil fumes to the kitchen environment, and improving the user experience. Moreover, the amount of oil fumes discharged to the outside per unit time is increased, the fume discharge efficiency is improved, and oil fume contaminants in the kitchen environment are effectively reduced, which is of great significance for improving the kitchen environment.

What is claimed is:

1. A fume collecting assembly, comprising a fume gathering panel having a curved concave portion, and an air deflector having a curved convex portion, wherein the air deflector is connected to the fume gathering panel, and the curved convex portion and the curved concave portion are opposite to each other and jointly form a first air inlet and a second air inlet spaced apart from each other; and the fume gathering panel comprises a fume collecting port, which is configured to discharge oil fumes into an air duct of a range hood, and both the first air inlet and the second air inlet communicate with the fume collecting port;

wherein the air deflector comprises an upper plate and a lower plate, wherein the lower plate, from bottom to top, is inclined from rear to front, the curved convex portion is located between the upper plate and the lower plate; and wherein the upper plate is arranged vertically; or the upper plate, from bottom to top, is inclined from rear to front at an angle $\alpha$, less than 15°, from a vertical plane; and/or an angle $\beta$ between the lower plate and the vertical plane satisfies $30° \leq \beta \leq 45°$.

2. The fume collecting assembly according to claim 1, further comprising a skeletal front plate located between the fume gathering panel and the air deflector, wherein the skeletal front plate is mounted to the fume gathering panel and supports the air deflector, and the first air inlet and the second air inlet are both provided on the skeletal front plate and are located on left and right sides of the skeletal front plate, respectively.

3. The fume collecting assembly according to claim 1, wherein the fume gathering panel is provided with a notch, and a lower end of the air deflector extends into the notch.

4. A range hood, comprising a range hood body and the fume collecting assembly according to claim 1, wherein the fume collecting assembly is mounted to the range hood body, and the fume collecting port communicates with the air duct located inside the range hood body.

5. The range hood according to claim 4, further comprising an oil receptacle mounted at a bottom of the range hood body, wherein the air deflector extending into a notch of the fume gathering panel is configured to direct an oil liquid into the oil receptacle.

6. The range hood according to claim 4, further comprising a switch component configured for controlling the range hood, wherein the air deflector is detachably fixedly mounted to a skeletal front plate of the fume collecting assembly, and the switch component is detachably fixedly connected to the air deflector.

7. The range hood according to claim 6, wherein the switch component is arranged on the upper plate.

8. The range hood according to claim 4, further comprising a locking member fixedly arranged at a bottom of the air deflector, wherein the locking member comprises an overlapping edge, the overlapping edge is arranged at an angle from the air deflector, and the locking member extends into a notch of the fume gathering panel and is overlapped onto the range hood body.

9. The range hood according to claim 8, wherein a guiding edge is extended from the overlapping edge towards a direction of an oil outlet of the range hood body, and an oil receptacle of the range hood is arranged directly under the oil outlet.

10. The range hood according to claim 9, further comprising a centrifugal fan configured for discharging the oil fumes, wherein an air duct of the centrifugal fan is provided with a bottom hole of the air duct, which enables an oil liquid in the air duct to drip onto the fume gathering panel through the bottom hole of the air duct and then flow to the oil outlet along the fume gathering panel.

11. The range hood according to claim 4, wherein the fume gathering panel is connected to both sides of the air deflector and forms a fume gathering region together with an outline of the air deflector; and two sides of the air deflector, from bottom to top, are inclined from a center towards two sides, so that the fume gathering region is gradually narrowed from bottom to top to form a positive pressure region.

12. The range hood according to claim 4, wherein the air deflector and the fume gathering panel are opposed to each other to form a hollow portion; the range hood further comprises a partition plate, which is placed in the hollow portion and divides the hollow portion into a left chamber and a right chamber, and the partition plate partitions the fume collecting port into a left fume collecting port and a right fume collecting port.

13. The range hood according to claim 12, further comprising a driving device arranged in the range hood body, wherein the driving device is configured to drive the partition plate to slide; and the driving device comprises a driving member, a first connecting rod, a second connecting rod, and a third connecting rod, wherein a first pivot joint is arranged in the range hood body, a second pivot joint is arranged on a blocking member, a driving end of the driving member, the first connecting rod, the second connecting rod, and the third connecting rod are sequentially hinged, and the driving member is mounted in the range hood body, the second connecting rod, at its position close to the first connecting rod, is pivotably connected to the first pivot joint, and a free end of the third connecting rod is hinged to the second pivot joint; or the driving device comprises a driving member, a fourth connecting rod, and a fifth connecting rod, wherein a third pivot joint is arranged in the range hood body, a fourth pivot joint is arranged on the blocking member, a driving end of the driving member, the fourth connecting rod, and the fifth connecting rod are sequentially hinged, and the driving member is pivotably connected in the range hood body, the fourth connecting rod, at its position close to the driving member, is pivotably connected to the third pivot joint, and a free end of the fifth connecting rod is hinged to the fourth pivot joint.

14. The range hood according to claim 12, further comprising a base mounted between the air deflector and the fume gathering panel, wherein the partition plate is pivotably connected to the base, a driving device is mounted to an inner side wall of the air deflector, the driving device is configured to drive the partition plate to rotate, a switch component of the range hood is arranged on an outer side wall of the air deflector, and the switch component is electrically connected to the driving device.

15. The range hood according to claim 12, wherein the range hood body is provided with an oil fume sensor, the oil fume sensor is electrically connected with a microprocessor, the microprocessor is electrically connected to a driving device, and the driving device is configured to drive the partition plate to rotate.

16. A central fume purification device, comprising a public flue and the range hood according to claim 4, wherein an exhaust pipe of the range hood communicates with the public flue.

17. The central fume purification device according to claim 16, further comprising an oil receptacle mounted at a bottom of the range hood body, wherein the air deflector extending into a notch of the fume gathering panel is configured to direct an oil liquid into the oil receptacle.

18. The central fume purification device according to claim 16, further comprising a switch component configured for controlling the range hood, wherein the air deflector is detachably fixedly mounted to a skeletal front plate of the fume collecting assembly, and the switch component is detachably fixedly connected to the air deflector.

19. The central fume purification device according to claim 16, further comprising a locking member fixedly arranged at a bottom of the air deflector, wherein the locking member comprises an overlapping edge, the overlapping edge is arranged at an angle from the air deflector, and the locking member extends into a notch of the fume gathering panel and is overlapped onto the range hood body.

20. The central fume purification device according to claim 19, wherein a guiding edge is extended from the overlapping edge towards a direction of an oil outlet of the range hood body, and an oil receptacle of the range hood is arranged directly under the oil outlet.

* * * * *